United States Patent [19]

Odom

[11] Patent Number: 4,561,238

[45] Date of Patent: Dec. 31, 1985

[54] BAG FILLING AND CLOSING APPARATUS

[75] Inventor: Robert E. Odom, Blaine, Minn.

[73] Assignee: Bemis Company, Inc., Minneapolis, Minn.

[21] Appl. No.: 613,975

[22] Filed: May 25, 1984

[51] Int. Cl.[4] ..... B65B 43/30

[52] U.S. Cl. ..... 53/573; 53/386; 493/125

[58] Field of Search ..... 53/573, 571, 386, 567, 53/459; 493/125

[56] References Cited

U.S. PATENT DOCUMENTS

| | | | |
|---|---|---|---|
| 3,050,918 | 8/1962 | Helm et al. | 53/386 |
| 3,469,367 | 9/1969 | Ayres et al. | 53/567 |
| 3,676,977 | 7/1972 | Rothmann et al. | 53/573 X |
| 4,086,746 | 5/1978 | Christy | 53/571 |
| 4,133,254 | 1/1979 | Odom et al. | 493/125 |
| 4,182,094 | 1/1980 | Lieder et al. | 53/571 X |
| 4,312,617 | 1/1982 | Livingston et al. | 414/121 |
| 4,345,629 | 8/1982 | Inglett, Jr. | 53/573 X |

*Primary Examiner*—James F. Coan
*Attorney, Agent, or Firm*—Clayton R. Johnson

[57] ABSTRACT

Bag filling and closing apparatus that includes a bag pick up and feed assembly mounted on a frame for removing the top closed bag from a vertical stack of bags on a magazine and feeding the bag into a bag positioner assembly to thereby straighten the bag and support it in a vertical condition at a desired position, a carriage assembly for clampingly engaging a bag supported by the positioner assembly and moving the bag to be vertically adjacent a saddle and shaker assembly, and beneath a scale hopper, opening the clamped bag, discharging product from the scale hopper through the carriage spout into the opened bag, the saddle and hopper assembly supporting the bag bottom and shaking the bag as it is being filled, a transfer assembly for grippingly supporting the filled bag while it is still clampingly engaged by the carriage assembly, and after the bag is released by the carriage assembly, move the filled bag to a conveyor assembly, and controls for controlling the operation of said assemblies.

25 Claims, 25 Drawing Figures

B
11
12
30
31
36
136
37
62
45
47
46
53
A
151
156
158
157
153
85
87
15
76
91
92
35
160
135
151
159
173
94
98a
20a
99c
26
13
326
314
107
119
330
332
333
331
327
335
334
113
99
112
329
328
20b
101
28
27
P
39
A
B

S
51
46
47
12
48
57
45
64
29
38
31
38
37
30
62
60
20
20
26
58
59
61
143
197
22
54a
S
54
54b
91
C
154
135
144
138
137
76
36
92
215
167
173
209
177
8
20
95
35
215
22
94
67
113a
99c
297
296
68
66
294
283
301
294
108
104
293
287
110
280
111
109
323
112
17
286
284
281
98a
295
288
291
284
13
291
288
98b
101
327
101
328
11
25
32

280
283
T
286
288
320
318
267
341
28
266
259
246
257
258
264
248
91
272
250
271
256
275
276
270
255
254
253
249a
249
14
251
260
247
261
40
211
309
297
293
294
291
287
262
29
310
301
286
307
296
315
289
263
39
314
25

350
352
353
354
355
356
357
351
365
366
367
368
369
370
371
372
373
374
375
376
377
378
379
380
16
397
398
399a
399b
400
401
401a
401b
401c
404
405a
405b
406
407
408
412
413
414
417
417a
418
418a
426
427
428
429
430
431
432
433
441
442
445
446
447
457
470
472
473
474
475
476
477
452
395
396
425
438
C19a
C19b
X0
X1
X2
X3
X4
X5
X6
X7
Y0
Y1
Y2
Y3
Y4
Y5
Y6
Y7
X0a
X6a
CR2a
18a
X7a
CR3a
CR12a
CR8a
X14a
X6b
X4a
Y4a
CR4a
X1a
X8b
X13a
Y5a
X6a
CR4b
X9a
X0b
CP2b
X8c
X7b
X13b
X8d
Y5b
CR1a
CRdc
Y9a
CR4d

BAG FILLING AND CLOSING APPARATUS

BACKGROUND OF THE INVENTION

A machine for automatically opening and filling a bag and transferring the filled bag to a discharge station.

In U.S. Pat. No. 3,469,367 to Ayres et al there is disclosed a machine for moving an empty plastic bag to a position remote from where it was clampingly engaged, a saddle assemby for supporting the bag as it is being filled, and an assembly for moving the filled bag to a conveyor assembly. U.S. Pat. No. 3,050,918 to Helm discloses a machine for removing a flat folded paper bag from a magazine, opening the bag and positioning the open bag on a spout assembly to be carried thereby to a filled bag release position. U.S. Pat. No. 4,312,617 to Livingston discloses a vacuum cup assembly for removing the top case blank from a vertical stack of blanks on a magazine and feeding the blank to the entry nip of an endless conveyor and a roller.

In order to make improvements in machines for opening and filling bags, particularly pinch bottom type of bags, this invention has been made.

SUMMARY OF THE INVENTION

Bag filling and closing apparatus that includes a feed assembly for removing a flat folded paper bag from a bag magazine and feeding the bag to a bag positioner assembly that initially supports the bag to be inclined upwardly and rearwardly and then moves the bag to an upright position at a bag clamping position, and a spout carriage assembly for clampingly engaging the bag at the clamping position, opening the clamped bag, moving the clamped bag to a filling station and after the bag is filled, release the filled bag. Preferrably a saddle and shaker assembly is located at the filling station to shake the bag and support the bag as it is being filled and that there is provided a transfer assembly for supporting engaging the filled bag while it is clamped to hold the bag top in a closed position and engage the bag side walls for transferring the filled bag from the filling station to a conveyor assembly at the discharge station.

One of the objects of this invention is to provide new and novel means for receiving an empty flat folded bag and moving it to a preselected vertical upright condition for being clampingly engaged by a traveling carriage assembly. Another object of this invention is to provide new and novel means for clampingly engaging the upper leading and trailing edge portions of a flat folded bag, moving said edge portions toward one another as the bag mouth is being opened, and after the bag is filled, moving said edge portions away from one another to close the bag mouth. In furtherance of the last mentioned object, it is another object of this invention to provide new and novel means for gripping the bag after the bag mouth has been closed and it is still being clampingly engaged to supportingly engaging the filled bag side walls and suspendingly move the filled bag from the filling station to a conveyor assembly. Another object of this invention is to provide new and novel means for supporting holding and closing the bag mouth of a filled bag and transferring the filled bag from a bag filling position to a conveyor assembly.

BRIEF DESCRIPTION OF THE DRAWINGS

FIG. 10 is a plan view of the carriage assembly with various parts broken away and the vacuum cups is a bag open position in solid lines and in a position to grip an empty bag in dotted lines, said view being generally taken along the line and in the direction of the arrows 10—10 of FIG. 3;

FIG. 11 is a side view of the carriage assembly that is generally taken along the line and in the direction of the arrows 11—11 of FIG. 3, with spout jaws shown in their down position and the bag clamps shown in their out position in solid lines and parts of the spout jaws shown in their up position and the bag clamps in their in position in dotted lines;

FIG. 12 is a rear end view of the carriage assembly that is generally taken along the line and in the direction of the arrows 12—12 of FIG. 10 with parts broken away;

FIG. 13 is a rear end view of the saddle assembly that is generally taken along the line and in the direction of the arrows 13—13 of FIG. 18;

FIG. 14 is a side view showing the saddle assembly and part of the bag transfer assembly, said view being generally take along the line and in the direction of the arrows 14—14 of FIGS. 4 and 13;

FIG. 15 is a fragmentary side view of the gripper assembly and the bag clamp subassembly in their bag gripping and bag clamp positions respectively, said view being generally taken along the line and in the direction of the arrows 15—15 of FIG. 16;

FIG. 16 is a plan view of one of the bag transfer subassemblies that is generally taken along the line and in the direction of the arrows 16—16 of FIG. 15, various parts not being shown;

FIG. 17 is a horizontal cross sectional view generally taken along the line and in the direction of the arrows 17—17 of FIG. 15 to more clearly show one of the lower bag side wall gripping mechanisms;

FIG. 18 is a plan view of the saddle assembly with parts broken away;

Figure 1:
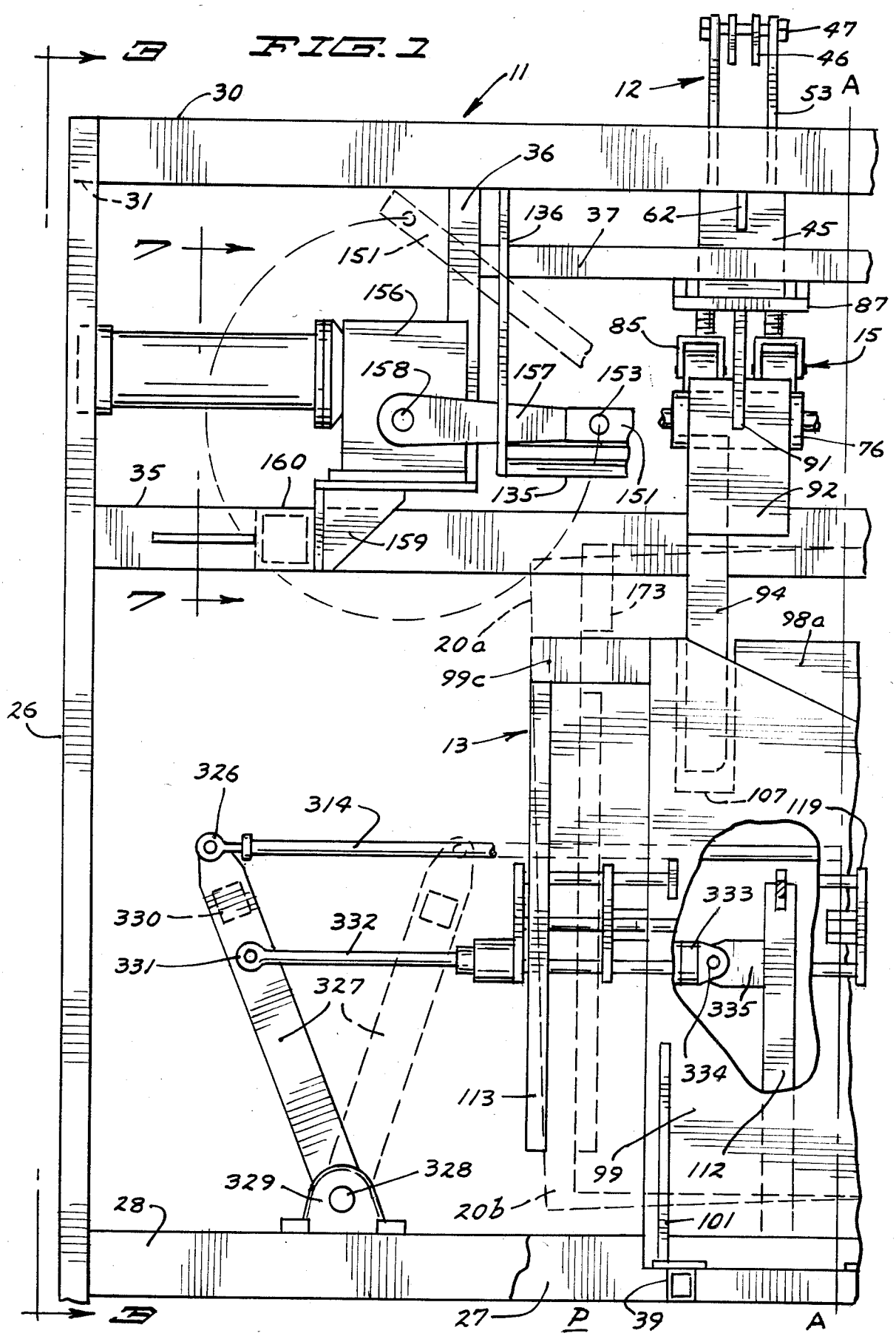
FIGS. 1 and 2 when taken together along lines A—A are a side view of this invention with various parts broken away and other parts not being shown.
Figure 2:
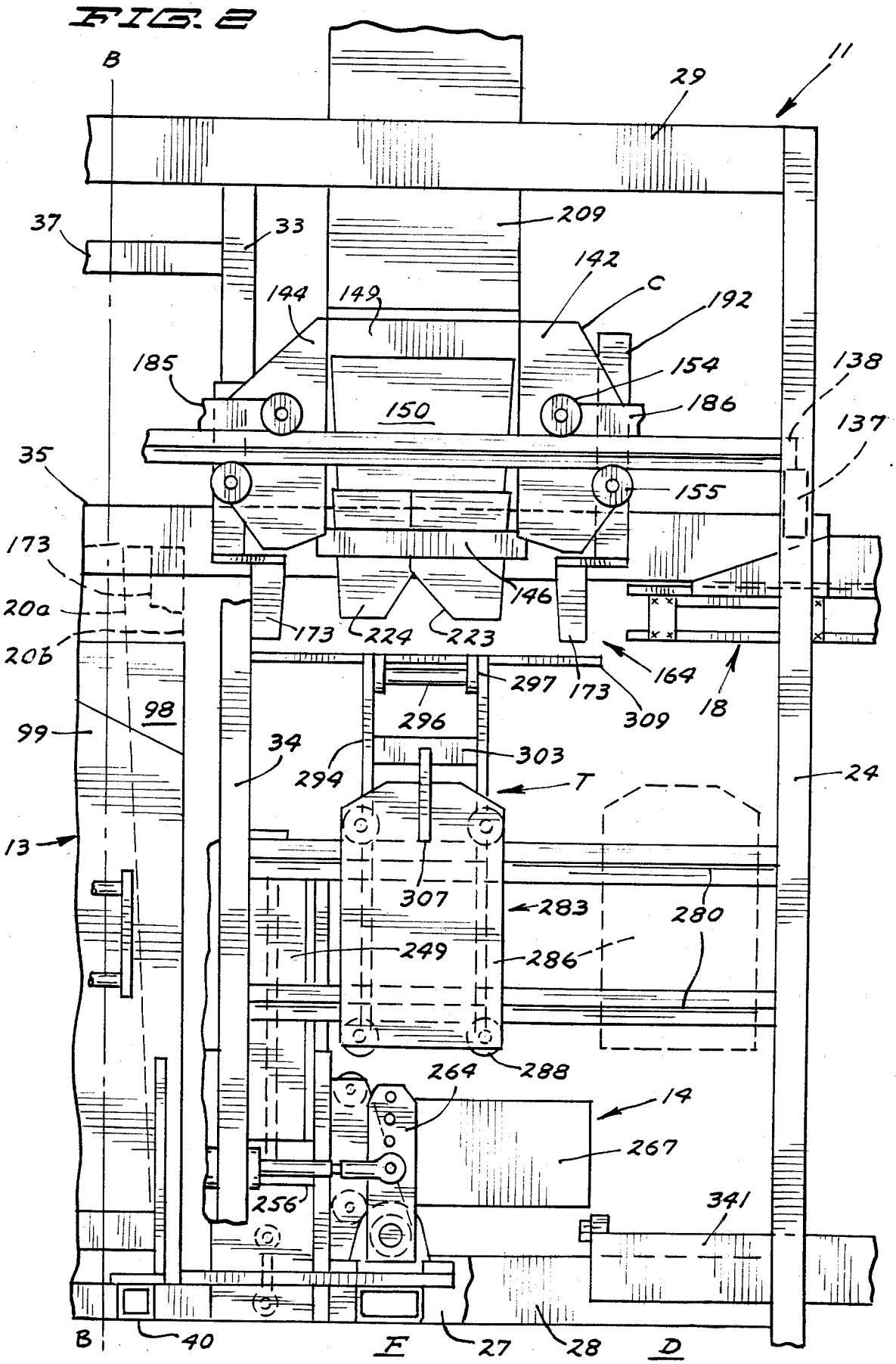
Figure 3:
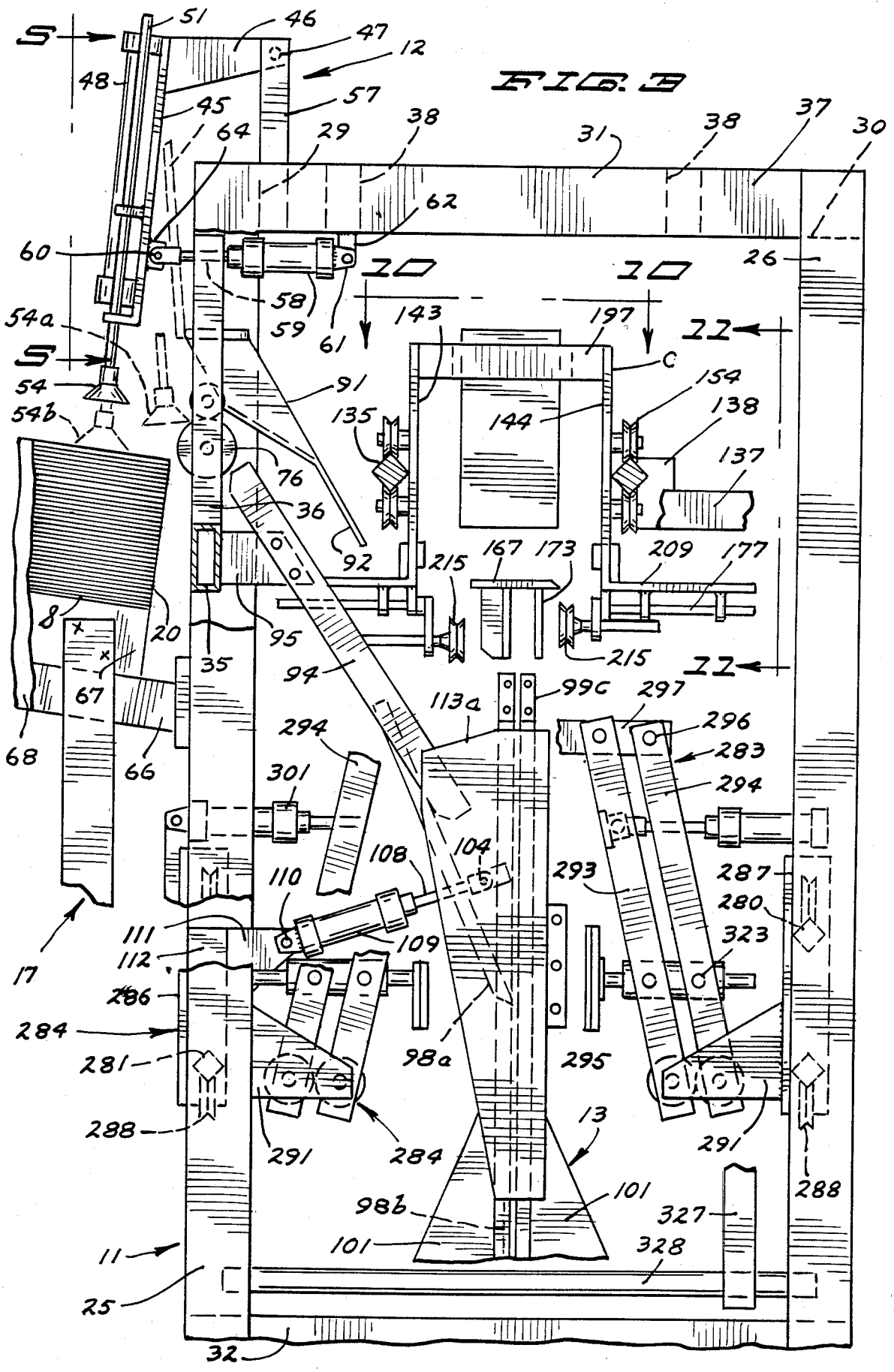
FIG. 3 is a rear end view generally taken along the line and in the direction of the arrows 3—3 of FIG. 1 with various parts broken away and others not being shown.

Referring in particular to FIGS. 1-3 the apparatus of this invention includes a main frame 11; a bag pick up assembly 12 on the frame for picking up the top bag 20 from a vertical stack S of horizontal, flat folded paper bags on the magazine 17; a feeder assembly 15 for feeding the folded bag into a positioner assembly 13 at the positioner station P to be properly aligned; a carriage assembly C for clampingly engaging the aligned bag, opening the bag, carrying the bag to a bag filling station F, discharging product into the opened bag at the filling station, and closing the filled bag; a saddle and shaker assembly 14 at the filling station for shaking the bag to settle product in the bag during the time it is being filled; a transfer assembly T for gripping the closed bag before it is released by the carriage assembly and supportingly carrying the filled closed bag from the filling station to a discharg station D and releasing the filled bag at the discharge station, a conveyor assembly 18 at station D for receiving the filled bag released by the transfer assembly for conveying the bag to other operations, and controls 16; each of the above being generally designated. The frame 11 includes a pair of front uprights 24, rear uprights 25, 26, lower longitudinal channels 27, 28, upper longitudinal channels 29, 30 extending between and joined to the front and rear uprights on the respective side of the machine, upper transverse channels 31 and lower transverse channels 32 extending between and joined to the front and rear uprights respectively, longitudinally intermediate uprights 33, 34 extending between and joined to the upper and lower longitudinal channels on the respective side of the machine, an intemediate longitudinal channel 35 extending between and joined to uprights 25, 33, an upright 36 longitudinally between uprights 25, 33 and extending between and joined to uprights 29, 35, a channel 37 joined to uprights 33, 36, upper longitudinal intermediate channels 38 extending between and joined to transverse channels 31, 31, and lower intermediate transverse channels 39, 40, 41 extending between and joined lower channels 27, 28.

Referring in particular to FIGS. 1, 3, 5 and 6, the bag pick up assembly 12 includes a mounting plate 45 that at its upper end is fixed to the one ends of arms 46. The opposite ends of the arms are pivotally connected 47 to the upper ends of bars 53 while the lower ends of the bars are attached to channel 29. The cylinder 48 of a piston cylinder combination 48, 49 is mounted on the mounting plate while the piston rod 49 mounts a longitudinal bar 50. The outer ends of bar 50 dependingly mount vacuum cups 54. Also connected to the bar 50 are the lower ends of guide rods 51, the rods being slidably extended through slide clamps 52 that are mounted on mounting plate 46.

In order to move the mounting plate 45 from a position for picking up a flat folded bag on the top of the forwardmost stack S on the magazine to a position to feed the picked up flat folded bag to the feed assembly 15 there is provided a transverse piston cylinder combination 58, 59 that has the piston rod 58 pivotally connected at 60 to a lug 64 welded to the mounting plate 45 (see FIG. 3). The cylinder 59 is pivotally connected at 61 to a lug 62 which is mounted by channel 38.

The magazine 17 includes framework 66 that mounts a longitudinally elongated endless coveyor 67 for having a plurality of longitudinally spaced vertical stacks S of bags 20 thereon. The stacks are positioned on the conveyor to have their bottoms adjacent the frame 11 and their mouths remote from frame 11. A stop plate 68 is mounted in position to stop the forward movement of a stack of bags carried by the conveyor to a proper position to be picked up by the pick up assembly. Since the magazine may be the same as that described in U.S. Pat. No. 4,133,254, except that the conveyor is transversely sloped in a downward direction toward frame 11, it will not be further described.

Referring in particular to FIGS. 1-3, 6 and 7, the feed assembly 15 includes a roller 76 keyed to shaft 77 to be rotated about a longitudinal axis. The opposite ends of shaft 77 are rotatably mounted by uprights 33, 36, a pulley sheave 78 being keyed to the shaft. Sheave 78 is driven by a belt 79 which in turn is driven by a sheave 83 keyed to the output shaft of the feed motor reducer combination 80. Combination 80 is mounted by a plate 81 that in turn is mounted by channels 82 that are attached to channel 35.

Cooperating with the driven roller 76 are a pair of longitudinally spaced idler rollers 85 that are rotatably mounted by the legs of U-shaped brackets 86. The web of each bracket is dependingly mounted from horizontal plate 87 by guide rod spring combinations 88 that constantly resiliently urge the brackets downwardly to be in abutting relationship to roller 76 but permit the idler rollers moving upwardly so that an empty flat folded bag can pass between them and roller 76. Plate 87 is mounted by blocks 89 that are dependingly mounted by channel 37. When the pick up cups move the bottom end portion of the top bag on the stack S upwardly and then rearwardly, the bag is moved into the entry nip formed by the rollers 76, 85.

A bracket 91 is dependingly mounted by plate 87 to in turn mount a baffle plate 92 that is transversely downwardly inclined in a direction toward the positioner assembly. The upper longitudinal edge of the baffle plate is adjacent to and above the exit nip of rollers 76, 85, the baffle upper portion **92*a* being inclined downwardly at a smaller angle than the baffle lower part 92*b*. The baffle plate 92 overhangs the rear portion of the bag slide 94 which is inclined downwardly toward the positioner assembly. The slide is mounted by a bracket 95 which in turn is mounted by channel 35**.

Referring now in particular to FIGS. 1, 3, 8 and 9, the bag positioner assembly includes a first and a second bag side wall support member 98, 99 that are transversely spaced and at their lower end portions are mounted on transverse plates 100 that in turn are mounted by channels 39, 40. Flanges 101 are joined to plates 100 and support members 98, 99. A bag bottom support 102 that is circular in vertical longitudinal cross section is mounted by and between the support members 98, 99 longitudinally forwardly of the rear half of the support members, elongated slots 103 being provided in the support members so that support 102 can be mountingly retained in selected vertical adjusted positions.

The lower edge portion of the upper part 98*a* of the support member 98 is pivotally connected to the upper edge portion of the lower part 98*b* by a hinge 97 to be pivoted about a longitudinal axis to the dotted line position of FIG. 3 that is transversely downwardly inclined toward support member 99. The rear portion of the upper part 98*a* is provided with an upwardly opening slot 107 to permit the upper part 98*a* in its inclined position to have its upper edge more remote from support member 99 than the part of the top surface of slide 94 at the same elevation while the lower edge of the slide surface of slide 94 is transversely between the inclined upper part 98*a* and the part of the support member 98 at the same elevation. When part 98*a* is in its vertical position part 98*a* is transversely between the last mentioned edge of slide 94 and support member 99.

In order to move the upper part 98*a* between its positions and limit the movement thereof, there is provided a piston cylinder combination 108, 109 that includes a piston rod 108 pivotally connected to a bracket 104 that is attached to the upper part 98*a* and a cylinder 109 that is pivotally connected at 110 to a bracket 111. Bracket 111 is mounted by the upper end of a frame member 112 which in turn is mounted by channel 27.

Figure 9:
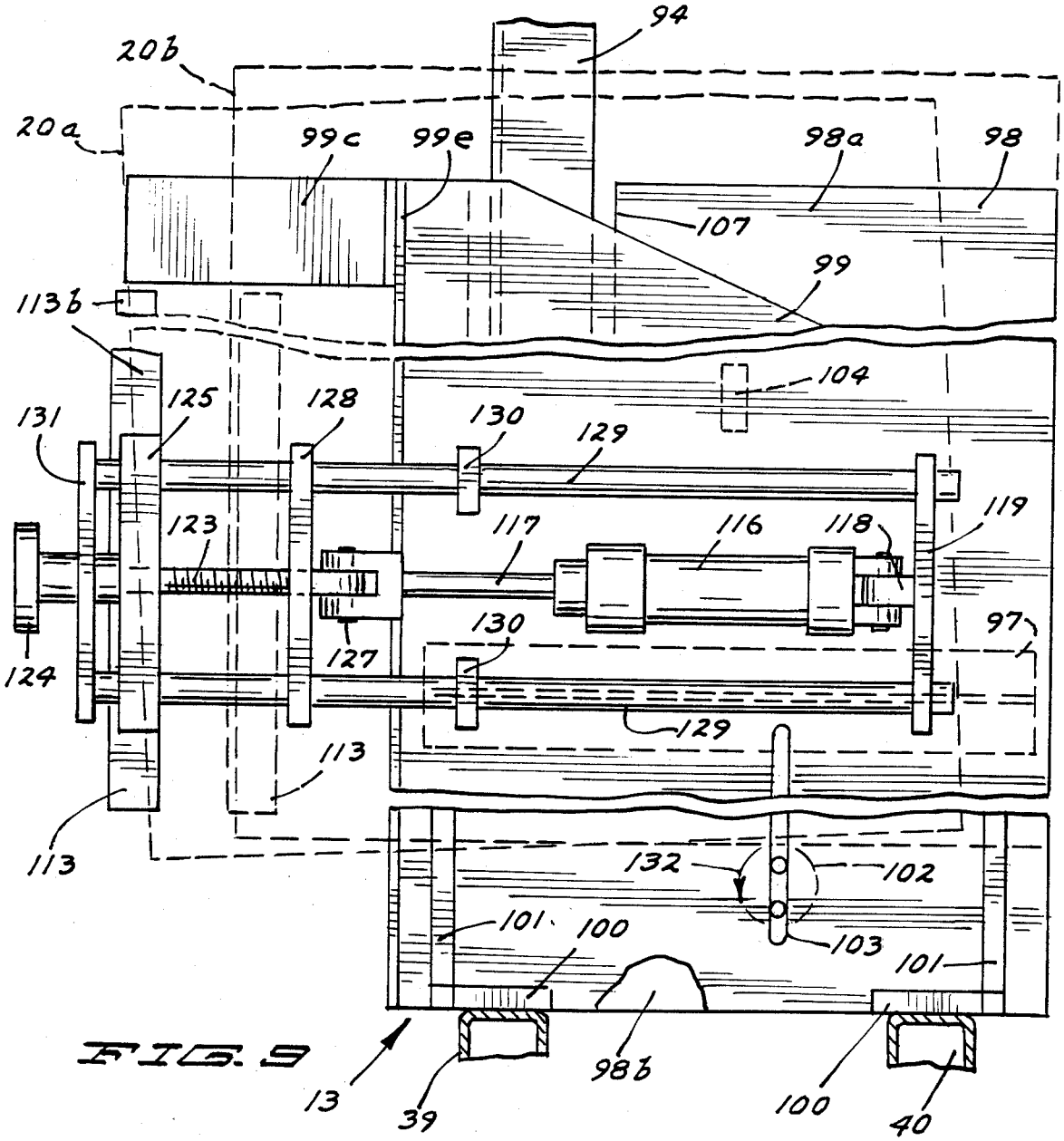
FIG. 9 is a side view of the apparatus of FIG. 8 with vertically intermediate parts broken away, said view being generally taken along the line and in the direction of the arrows 9—9 of FIG. 8 and showing a bag prior to being aligned and a bag after being aligned in dotted lines.

The flat folded bag fed by the feed assembly slides over slide 94 with the upper part 98*a* in its inclined position so that the bag bottom edge abutting against the bag bottom support, the bag pivots about the support to be inclined upwardly and rearwardly; and upon the upper part 98*a* being returned to its vertical position, is longitudinally inclined such as indicated in dotted lines in FIGS. 1 and 9 by bag 20*a*. The rearward angle of inclination is limited by the upper rear edge portion of the bag abutting against the pusher member 113 in the bag positioner receiving position that is shown in solid lines in said Figures. Each of the main body 99*a* of support member 99 and the main body of part 98*a* has joined to the rear reinforcing flanges 98*e*, 99*e* thereof, a bag top support 99*c*, 98*c* respectively that in the upper part 98*a* vertical position extends as far rearwardly as the transverse portion 113*a* of the pusher member in the bag receiving position and at a higher elevation.

The part of flange 98*e* and the adjacent part of the corresponding flange of part 98*b* are cut away to permit part 98*a* to move to its inclined position. When upper part 98*a* is in its vertical position, the main bodys of bag support members 98, 99, including those of bag top support 98*c*, 99*c* have adjacent surfaces parallel to one another and transversely spaced a little greater than the thickness of the flat folded bag that is fed therebetween. Further bag support 102 is vertically adjusted so that a bag supported thereby in its upright position of the bag, the bag top will extend sufficiently above the top edges of the support members to be clampingly engaged by the clamp members and engaged by bag opening vacuum cups as will be described hereinafter.

Figure 8:
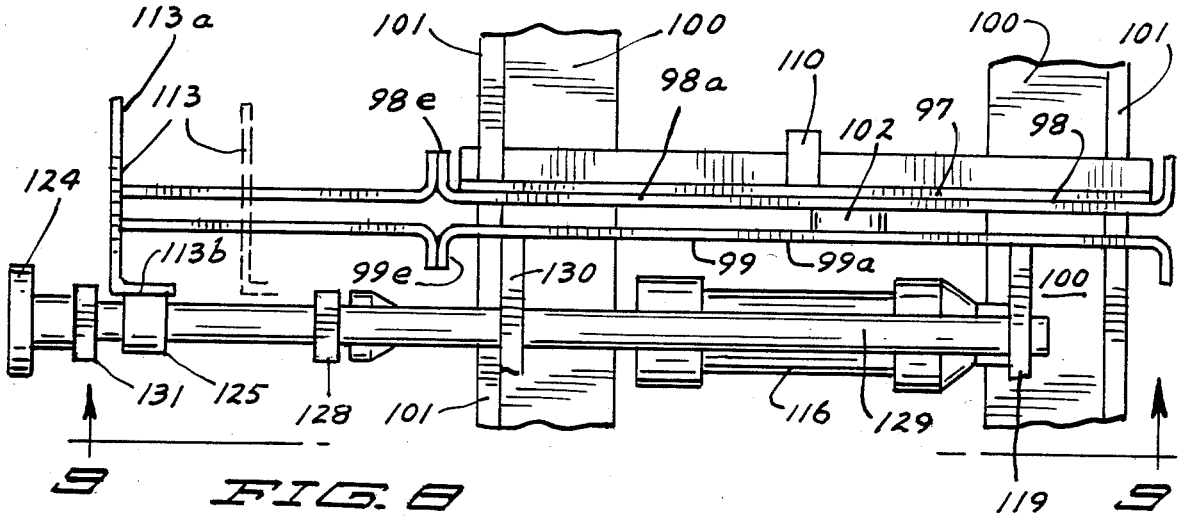
FIG. 8 is a fragmentary plan view of the bag positioner assembly with the bag alignment subassembly shown in a bag receiving position in solid lines and the pusher member in a bag aligned position in dotted lines.

In order to mount the pusher member and translatorily move it from its solid line bag receiving position to its forward dotted line bag aligned position of FIGS. 1, 8 and 9, the cylinder 116 of piston cylinder combination 116, 117 is pivotally connected to a lug 118 which is fixed to a vertical guide plate 119. Plate 119 is mounted by support member 99. The piston rod 117 is pivotally connected to a lug 127 which in turn is attached to the intermediate part of a spacer bar 128.

Keyed to the spacer bar 128 are intermediate portions of longitudinally elongated slide rods 129, the rods being slidably extended through slide lugs 130 mounted by support member 99, and bar 119. Also keyed to the rear ends of the slide rods is a mounting bar 131. The mounting bar rotatably mounts an adjustment knob 124 which is keyed to a threaded shaft 123. The shaft threadedly extends through a vertical bar 125 which is slidably mounted by rods 129 so that as the knob is rotated bar 125 moves longitudinally for adjusting the position of the vertically elongated pusher member 113 which has the flange 113*b* mounted by bar 125. Thus as piston rod 117 is retracted rods 129, shaft 123, bar 125 and the pusher member move forwardly to move bag 20*a* to pivot about the bag bottom support 102 and slide forwardly to be in the vertical aligned position indicated in dotted lines by bag 20*b*. In the vertical aligned position the center of gravity of the bag is still rearward of support 102 so that it tends to pivot in the direction of arrow 132 about support 102 (see FIG. 9) but is prevented from doing so by its rear edge abutting against pusher member portion 113*a* and extending substantially parallel thereto.

In order to mount the carriage assembly C for movement from the filling station F to the bag positioner station P where it clampingly engages an empty bag in the position indicated by bag 20*b*, a pair of longitudinally elongated transversely spaced, diamond shaped rails 135 are provided that at their rear ends are mounted by the lower ends of bars 136, the upper ends of which are mounted by channels 38. The opposite ends of the rails are mounted by a plate 138 which in turn is mounted by a main frame transverse channel 137 that at its opposite ends is joined to uprights 24.

Referring to FIGS. 10–12, the carriage assembly includes a carriage frame, generally designated 140, that has transversely spaced vertical front side plates 141, 142 and rear side plates 143, 144. Front and rear upper transverse braces 147 extend between and are joined to the front and rear set of side plates respectively while upper longitudinal braces 145, 148, 149 extend between and are joined to the braces 147. Lower longitudinal frame members 146 extend between and are joined to the front and rear side plates on the respective side of the carriage frame. Braces 147, 148, 149 form an open rectangular frame for mounting a spout portion 150 to depend therefrom.

Each of the side plates 141–144 rotatably mounts upper and lower grooved wheels 154, 155 to engage the upper and lower apex portions of the rails 135 on the respective side of the carriage frame so that the carriage assembly extends above and below the rails and therebetween. To move the carriage assembly between the positoner station P to be above an upright bag in the positioner assembly to clampingly engage the upright bag (indicated by the dotted line position of rod 152 in FIG. 4) and the filling station F (see solid line position of rod 152 in FIG. 4), a longitudinally elongated bar 151 at one end is pivotally connected to a rear transverse rod 152 that is mounted by side plates 143, 144 (see FIGS. 1, 2, and 12). The rear end of bar 151 is pivotally connected at 153 to one end of a crank arm 157, the opposite end of arm 154 being keyed to the output shaft 158 of the carriage motor reducer combination 156. Combination 156 is mounted on a mounting bracket 159 which in turn is mounted by a tranxverse rear channel 160, channel 160 being mounted by channel 35.

Referring again to FIGS. 10–12, for clampingly engaging an empty flat folded bag at the position station and holding the bag in a clamped condition until after the bag is filled at the filling station there is provided front and rear clamp assemblies, generally designated 164, 165 respectively that respectively have mounting plates 166, 167. Each clamp assembly includes a clamp member 170 mounted by bars 171 which in turn are depending mounted on plates 166, 167 respectively to be stationary relative thereto on one transverse side of a vertical longitudinal divider plane which extends between the positioner assembly support members. A transversely movable clamp member 173 is mounted by piston rod 174 of the piston cylinder combination 174, 175, the cylinder 175 being mounted by plates 176 that are dependingly secured to the mounting plate 166, 167 respectively. A guide rod 177 is fixed to the clamp member 173 and slidably extended through plates 176.

The rear clamp member 170 is longer than front clamp member 170 and extends rearwardly for mounting a deflector 172 that extends rearwardly and transversely in a direction away from clamp member 173. The deflector serves to insure that the bag top in the positoner assembly is straightened to be between clamp members 170, 173 when the carriage asssembly moves to the positioner station.

In order to mount the clamp assemblies and selectively longitudinally move the clamp assemblies toward one another to an "in" position and away from one another to an "apart" position, for each clamp assembly there is provided clamp assembly mounting mechanism, generally designated 180. Each mechanism 180 includes a pair of transversely spaced lugs 181 that are fixed to the respective mounting plate 166, 167 to extend thereabove. Each lug is pivotally mounted on a transverse pivot 182 which in turn is pivotally mounted by the lower end of a swing link 183. The upper end of each link is pivotally mounted by a transverse pivot 184, each rear pivot 184 being mounted by a rear arm 185 and each front pivot 184 being mounted by a front arm 186. The mid-portions of the arms are pivotally mounted by transverse pivots 187 to the adjacent side plate 141–144, the front and rear pivots 187 being longitudinally more closely adjacent one another than the front and rear pivots 184.

The pivot axes of rear pivots 187 are coextensive with the central axis of rod 152 which is rotatable while the pivot axes of the front pivots 187 are coextensive with the transverse rod 190 that is rotatably mounted by side plates 141, 142. Rod 152 mounts transversely spaced rear swing arms 191 to rotate therewith while rod 190 mounts transversely space front swing arms 192 to rotate therewith. The lower end of each of the arms 191, 192 is pivotally connected to the adjacent lug 181 by a pivot 193. The front and rear pivots 182 are more remotely longitudinally spaced from one another than the front and rear pivots 193. Further the spacing of the adjacent pivots 182, 184 and 187, 193 from one another is the same while the spacing of adjacent pivots 184, 187 from one another is slightly greater than the spacing of pivots 182, 193 whereby as the clamp members 170, 173 are swung from their solid line apart position of FIG. 11 to their dotted line in position the top parts of the front and rear clamp members move more closely adjacent one another than their lower parts. Stops 189 are provided on arms 185, 186 to abut against the rails 135 to limit their swinging movement in a direction from their in position to to their apart position.

In order to swing the clamp members as indicated above one end of a link 197 is pivotally connected at 198 to the upper end of a front arm 192 (opposite side of pivot 187 from pivot 193) while the opposite end is pivotally connected at 199 to an arm 191 intermediate pivot 187, 193. A lug 200 is welded to an intermediate part of link 197, the piston rod of a piston cylinder combination 202, 203 being pivotally connected at 201 to the lug. The cylinder 203 is pivotally connected at 204 to a lug 205 that is mounted by by front brace 147. When the piston rod 202 is retracted the front clamp assembly is swung rearwardly as the rear clamp assembly is swung forwardly.

For opening a bag clamped by the clamp assemblies after or as the clamp assemblies move toward their "in" position there is provided a pair of bag opening assemblies, genereally designated 208. Each assembly 208 includes a horizontal mounting plate 209 that is mounted by bracket 210 to the adjacent brace 146 to extend transversely away from the brace in a direction away from the other mounting plate 209. Each mounting plate mounts a cylinder 211 of a piston cylinder combination 211, 212, the piston rod 212 of which mounts a longitudinal bar 213. Each end portion of bar 213 dependingly mounts a vertical bar 214 (bars 214 of one assembly being longer than the other), the lower end of each bar mounting a vacuum cup 215. Thus each assembly 208 includes a pair longitudinally spaced bag opening vacuum cups. The one ends of a pair of transverse guide rods 216 are joined to bar 213 and are slidably extended through guide bars 217, 218 that are dependingly secured to mounting plate 209.

Figure 26:
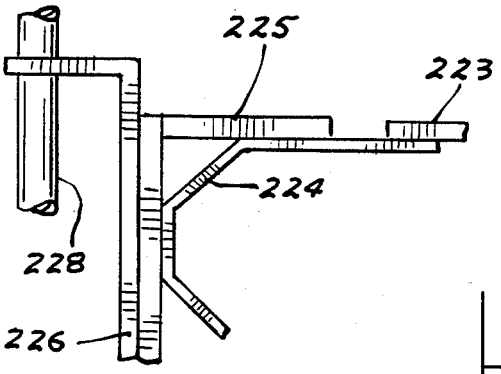
FIG. 26 is a fragmentary plan view shoing the mounting of the spout jaws.

To aid in directing material dischared through scale hopper 209 into the opened bag there is provided a spout assembly, generally designated 222 that includes the above mentioned spout portion 150 and oppositely faced spout jaws 223, 224 that as shown in their solid line down position in FIG. 11 (also see FIG. 26) partially overlap and are movable to the dotted line up position. The web portion of each jaw is connected to the web portion of a generally U-shaped bracket 225, while the longitudinally extending legs of each jaw is connected to the legs of the respective bracket 225. The web of each bracket 225 is fixed to the web of a generally U-shaped bracket 226, the transversely spaced legs of bracket 226 being fixed to the front and rear rod 228 respectively to rotate therewith about transverse axes. Rods 228 are rotatably mounted by the front and rear side plates 141, 142 and 143, 144 respectively.

To rotate the rear rod 228 an arm 230 is fixed to a reduced diameter end portion thereof while the opposite end of the arm is pivotally connected at 231 to one end of a link 232. The other end of the link 232 is pivotally connected at 233 to a bracket 234 which in turn is pivotally mounted on a reduced diameter portion of front shaft 228. For pivoting bracket 234, a piston rod 239 of the spout piston cylinder combination 239, 240 is pivotally connected at 241 to bracket 234, the cylinder 240 being pivotally connected at 242 to side plate 142. As may be noted pivots 233, 241 and front shaft 228 are located at the apexes of a triangle and are located relative one another and pivot 231 and the rear shaft 228 so that as bracket 234 is pivoted in one direction to rotate the front shaft 228 in the same direction, the rear shaft 228 is rotated in the opposite direction. When the piston rod 239 is retracted, the spout jaws are entirely at a higher elevation than the top edge of an aligned bag 20*b* in the positioner assembly as is the lower peripheral edge of spout portion 150. When the piston rod 239 is extended the spout jaws extend to both a higher and lower elevation than the lower edge of spout portion 150.

Referring in particular to FIGS. 2, 13, 14 and 18, a shaker saddle assembly 14 is located at the filling station for shaking a bag during the filling operation. The assembly 14 includes a pair of transversely spaced mounting plates 245 that are mounted by channels 40, 41. Each plate 245 mounts a front and rear upright bracket 246, 247 respectively that are longitudinally spaceed, each bracket mounting vertically aligned upper and lower grooved wheels 248.

At each transverse side of the machine there is provided a generally rectangular vertically elongated box shaped post 249 that opens transversely toward the other. The transverse outer side plate 249*a* of each post mounts a front and rear vertical guide plate 250, 251 respectively having apex edges extending into the grooves of the wheels mounted by the front and rear bracket 246, 247 so that the post can only be vertically reciprocated when the guide plates extend between the upper and lower wheels.

For vertically moving each post 249 one end of a link 253 is pivotally connected at 254 to the adjacent post bottom portion 249*g* which is located to extend between post walls 249*a*, 249*b* and secured thereto while the opposite end is pivotally connected at 255 to the outer end of crank arm 256. The other end of each crank arm is welded to a transverse shaft 257 that has its opposite ends journalled for pivotal movement by bearing mounts 258 that are mounted on plates 245.

One end of an arm 264 is keyed to one end of shaft 257, a pivot member 259 being extended through the selected on of apertures radially spaced from the shaft for pivotally connecting the piston rod 260 of the shaker piston cylinder combination 260, 261 to a plate 264. Cylinder 261 is pivotally connected at 262 to a plate 263 that is attached to channel 28.

There is provided on each post a longitudinally elongated right angle bag saddle member 267 that extends a substantial distance forwardly of the post and has a horizontal leg extending transversely toward the other but spaced therefrom sufficiently to permit a flat folded bag carried by the carriage assembly moving therebetween. The vertical leg of each saddle member is secured to a slide block 268 to move therewith, the slide block being mounted within the respective post for vertical movement with the post vertical end walls 249*b* preventing pivotal movement of the block. For retaining the block in the respective post, a slide plate 270 is secured to the block by screws 271 that extend through vertically elongated, transversely spaced slots 272 in post wall 249*a* with wall 249*a* being between the block and slide plate.

For vertically moving the saddle members between an upper adjusted position shown in solid lines in FIG. 13 to a lower adjusted dotted line position, a threaded jack 275 for each post is threadedly extended through block 264 and is journalled for rotation about a vertical axis by the respective post top wall 249*c*. A hand crank 276 is provided for turning each jack.

In order to mount the transfer assembly T and move it from the solid line filled bag gripping "in" positon of FIGS. 2 and 14 at the filling station and just longitudinally forwardly of the the posts 249 to the dotted line bag release "out" position at the discharge station D, at each side of the frame their is provide a pair of longitudinally elongated, vertically spaced rails 280, 281 respectively. The rails 280 at one side extend between and are mounted by uprights 36, 24 while the rails 281 at the other side are mounted by uprights 33, 24.

The transfer assembly includes a transfer subassembly, generally designated 283, mounted for movement on rails 280, and a transfer subassembly, generally designated 284, mounted by rails 281. Since the subassemblies are the same, except one is a right hand subassembly and the other a left hand one, primarily only the structure of subassembly 283 will be described.

Referring now in particular to FIGS. 2, 3, 15 and 16, the subassembly 283 includes vertical mounting plates 286, 287 on opposite sides of the rails that mount upper and lower grooved wheels 288 to run on the upper apex of upper rail 280 and the lower apex of the lower rail. The mounting of the wheels and spacers 289 hold the plates 286, 287 together in said spaced relationship. Front and rear swing arms 294 are maintained in parallel relationship to front and rear swing arms 293 by having their upper ends pivotally connected at 296 to front and rear horizontal arms 297, and their lower ends pivotally connected at 295 to brackets 291 that are mounted by plate 287 to extend transversely inwardly.

In order to move the arms between their solid line bag gripping 'in' position of FIG. 15 to their dotted line datum "out" position, the piston rod 300 of the gripper piston cylinder combination 300, 301 is pivotally connected at 302 to a longitudinal brace 303 which in turn is attaced at its opposite ends to arms 293. Cylinder 301 is pivotally connected at 306 to a bar 307 that is mounted by plate 286.

The transverse inner ends of the horizontal arms 297 mount a longitudinally elongated plate 309 which in turn mounts upper and lower clamp plates 310. The clamp plates mount an elongated upper gripper member 311 therebetween to extend transversely inwardly to in cooperation with the gripper member of subassembly 284 grippingly engage opposite side walls of a filled bag at the filling station and extend longitudinally the width of the bag above the level of product in the bag when subassemblies 283, 284 are in their bag gripping position. Advantageously the gripper members may be of a material such as hard rubber.

The subassemblies also each include a lower gripper member 318 which may be made up of an inner resilient pad 318*a* and a backing plate. Gripper member 318 is mounted by the inner ends of rods 319 (see FIGS. 15, 17). The rods are slidably mounted to be retained in transversely adjusted positions by box 320 that includes releasable clamp mechanism (not shown). The front and rear walls of the box each are pivotally connected at 323 to the adjacent arms 293, 294 so that the rods 319 remain parallel to arms 297 as the gripper members are moved between their bag gripping and bag release positions. The lower gripper members 318 are more remotely transversely spaced than gripper members 310 and located to grip the side wall portions of a filled bag intermediate the top and bottom levels of product in the bag.

Figure 4:
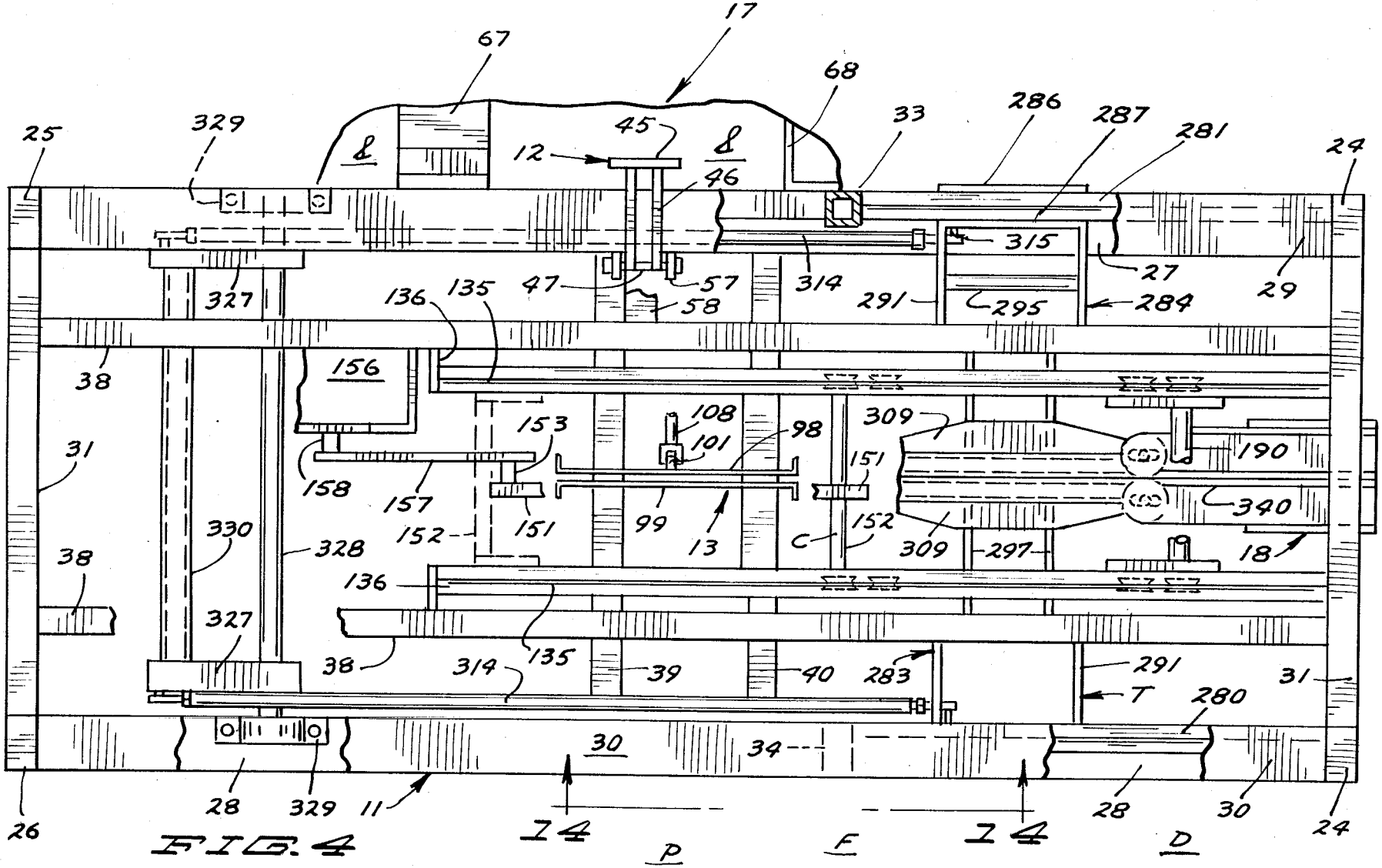
FIG. 4 is a plan view of this invention with various parts broken away and others not being shown.

In order to move the transfer subassemblies between the filling station and the discharge station, an elongated rod 314 is pivotally connected at 315 to each of the plates 287 (see FIGS. 1, 4 and 16). The opposite end of each rod 314 is pivotally connected at 326 to the upper end of an arm 327, the lower end of the arms being fixed to transverse shaft 328. The opposite ends of the shaft are pivotally mounted by bearing mounts 329 that in turn are mounted on channels 28, 29 near the rear end of the machine. A cross brace 330 is secured to the upper end portions of the arms.

For moving the arms 327 between the solid line transfer assembly showing at the filling station and the dotted line position at the discharge station of FIGS. 1 and 2, the piston rod 332 of the piston cylinder combination 332, 333 is pivotally connected at 331 to one of arms 327 while the cylinder 333 is pivotally connected at 334 to bracket 335. Bracket 335 is mounted by upright 112.

As the filled bag is moved to the discharge station, the portions of the bag walls above the upper gripper members move into the entry nip of a pair of driven endless conveyor members 340 of a conventional conveyor assembly 18 to hold the bag top closed in a conventional manner while the bag bottom is moved over the horizontal run of the lower part 341 of the conveyor assembly. After the bag top has moved between the conveyor members 340, the gripper members are moved transversely away from their gripping position.

Referring now to FIGS. 19–24, there is a simplified schematic showing of the control circuit and components 16 for controling the operation of the machine of this invention. The controls include main lines 350, 351, junctions 352–358 being provided on line 350 and junctions 365–390, 392–394 being provided on line 351. A line 395 having a junction 396 is connected to junction 372.

A manually operated stop switch 397 that is resiliently retained in a closed condition is connected across junctions 352, 398 while a switch member 399*a* of a machine start switch that is resiliently retained in an open condition is connected across junctions 398, 400. The solenoid coil 401 of a start relay is connected across junctions 400, 365 and when energized closes hold-in switch member 401*a* that is connected across junctions 398, 404, and switch member 401*b;* opens switch member 401*c;* and closes switches (not shown) for energizing a bag opening vacuum pump (not shown). Switch member 401*b* is connected across junctions 356, 426, a line 425 having junctions 427–440, 443 thereon being connected to junction 426 and a line 361 having junction 360 thereon being connected to junction 440 and a line 441 having a junction 442 thereon being connected to junction 426.

Relay switch member 401*a* is connected across junctions 398, 404, junction 400 being connected by a line to junction 404. A manually operated "on"-"off" bag feed switch has a switch member 405*a* connected across junctions 404, 406. The solenoid coil 407 of the relay for the magazine vacuum pump (not shown) is connected across junctions 406, 366 for, when energized, closing switch members (not shown) to energize a vacuum pump (not shown) that is the source of vacuum for cups 54. The solenoid coil 408 of a bag feed relay when energized closes switch members (not shown) for energizing the bag feed motor 80.

Connected across junctions 404, 368 is the solenoid coil 412, which when energized energizes the relay for supplying power to the motor of the carriage motor reducer combination 156. A programmed control sequencer 414 is connected across junctions 353, 369. Even though the sequencer is conventional, the program is not.

Connected in parallel across junctions 355, 371 are the bag in magazine and a bag in positioner photo cell units 417, 418 respectively. Unit 417 has a switch member 417*a* that is open as long as a bag is on the magazine in abutting relationship with stop plate 68 in a position to be picked up by cups 54, but is closed when no bag is in such a position. Unit 418 has a switch member 418*a* that is closed when no bag is at the bottom of the positioner assembly, but opens when a bag is on support 102.

The solenoid coil 457 os the bag release timer and switch member C19*a* of the scale dump relay are connected in series across junctions 354, 370.

Figure 25:
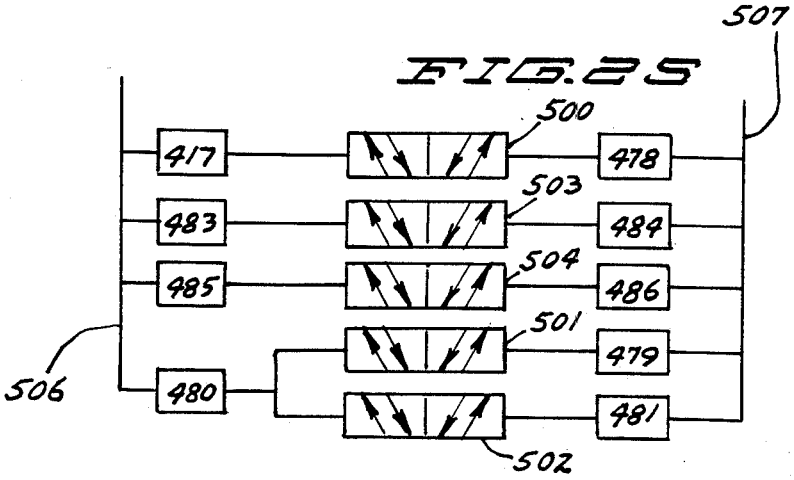
FIG. 25 is a schematic showing of some of the solenoid controlled valves.
Figures 2B, 7:
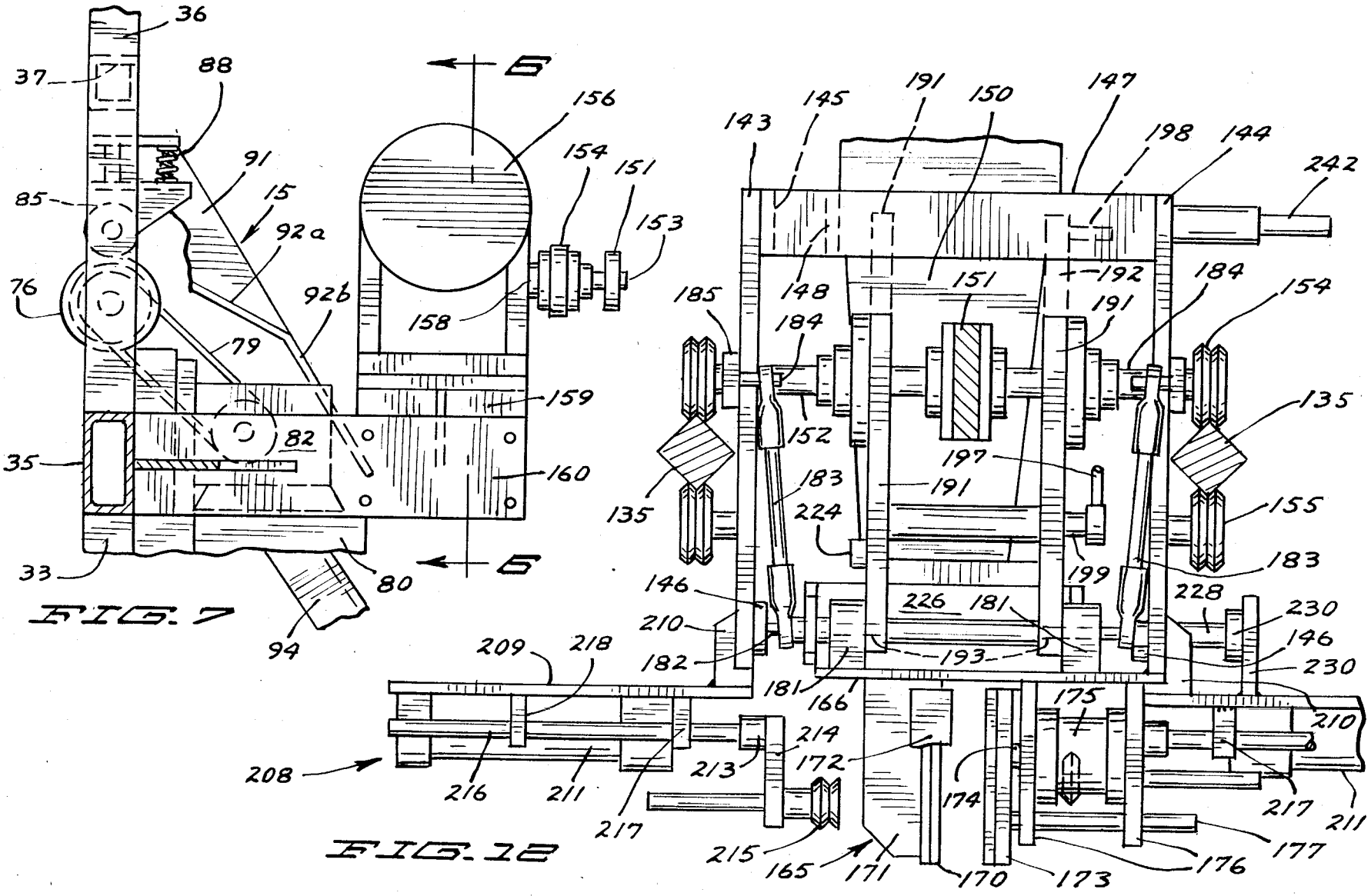
FIG. 7 is a fragmentary rear view that is generally taken along the line and in the direction of the arrows 7—7 of FIG. 1 to show portions of the feed assembly and carriage drive.
Figures 2, 20:
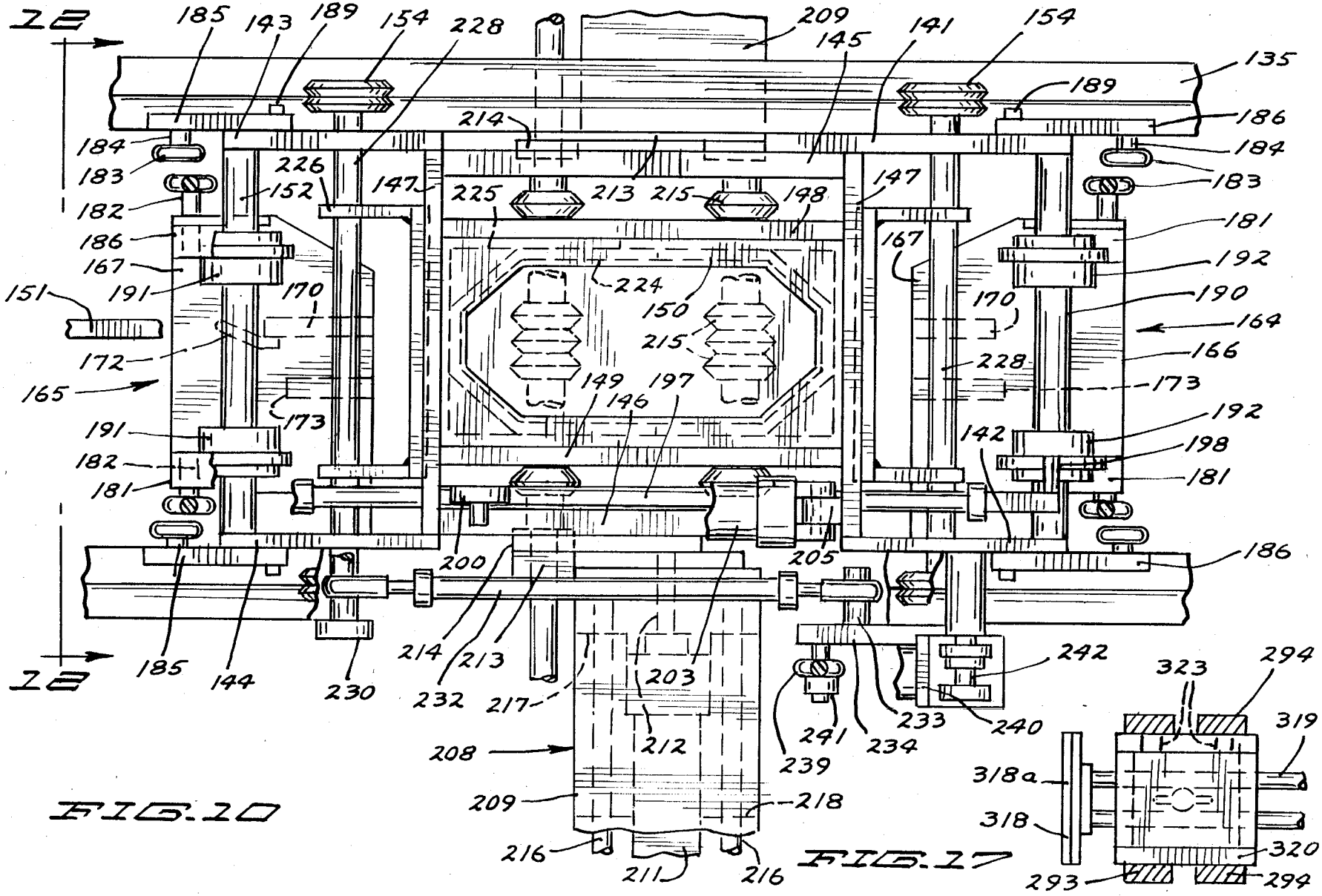
FIGS. 19 and 20 are a schematic showing of machine controls and components.
Figure 22:
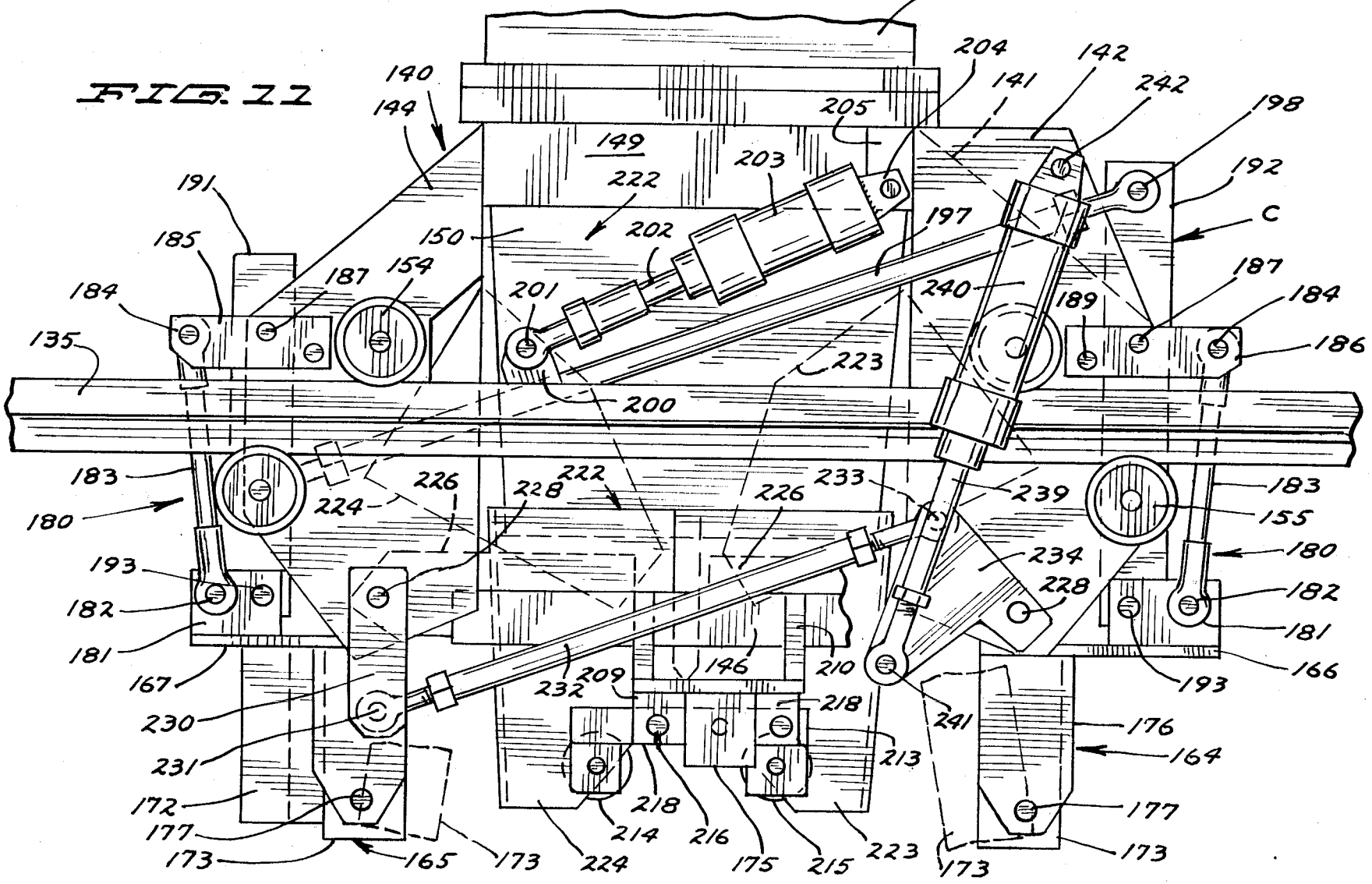
FIGS. 21 and 22 are a schematic showing of the sequencer logic program outputs.
Figures 25, 26, 27:
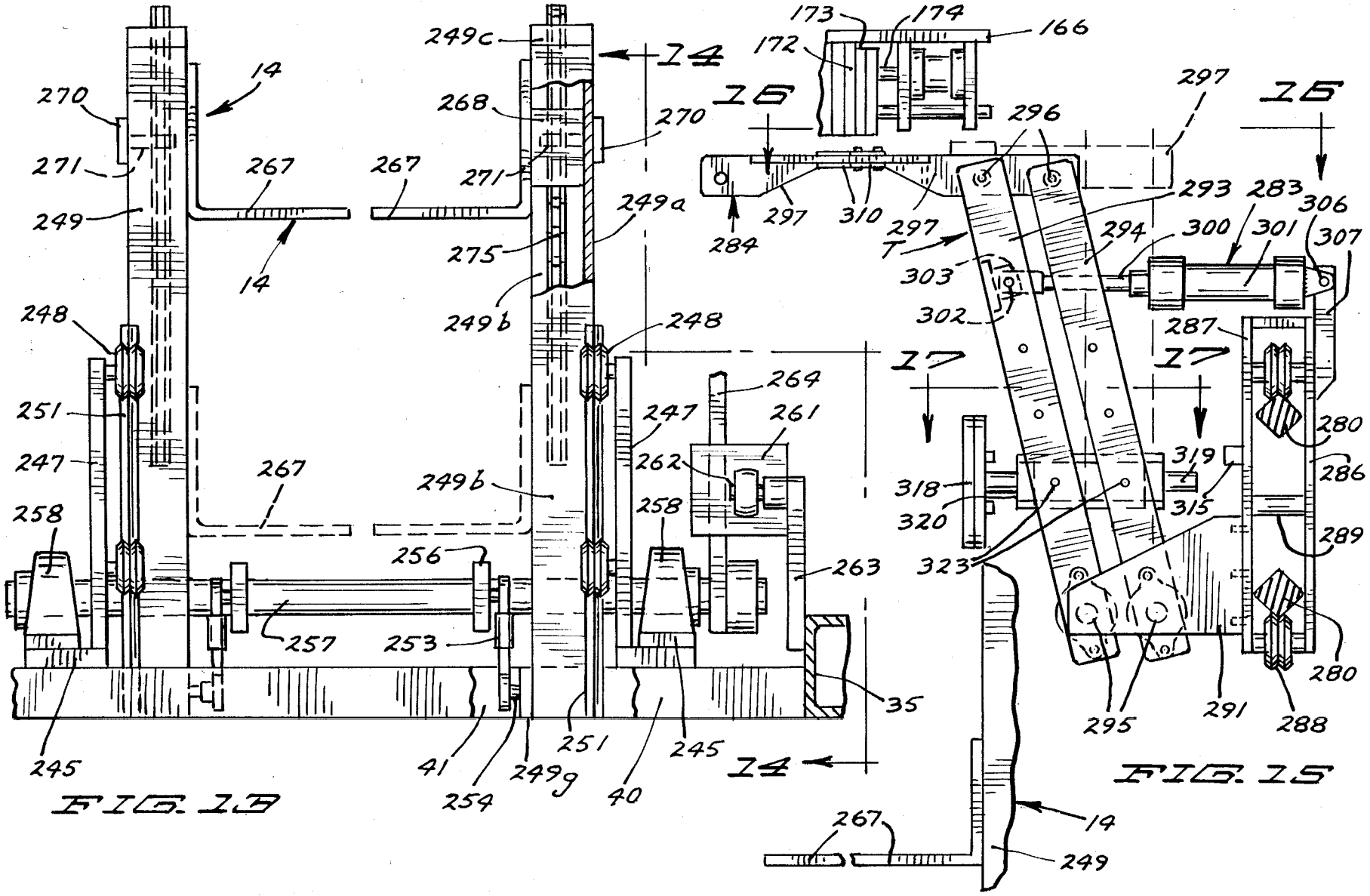
Figures 24, 25:
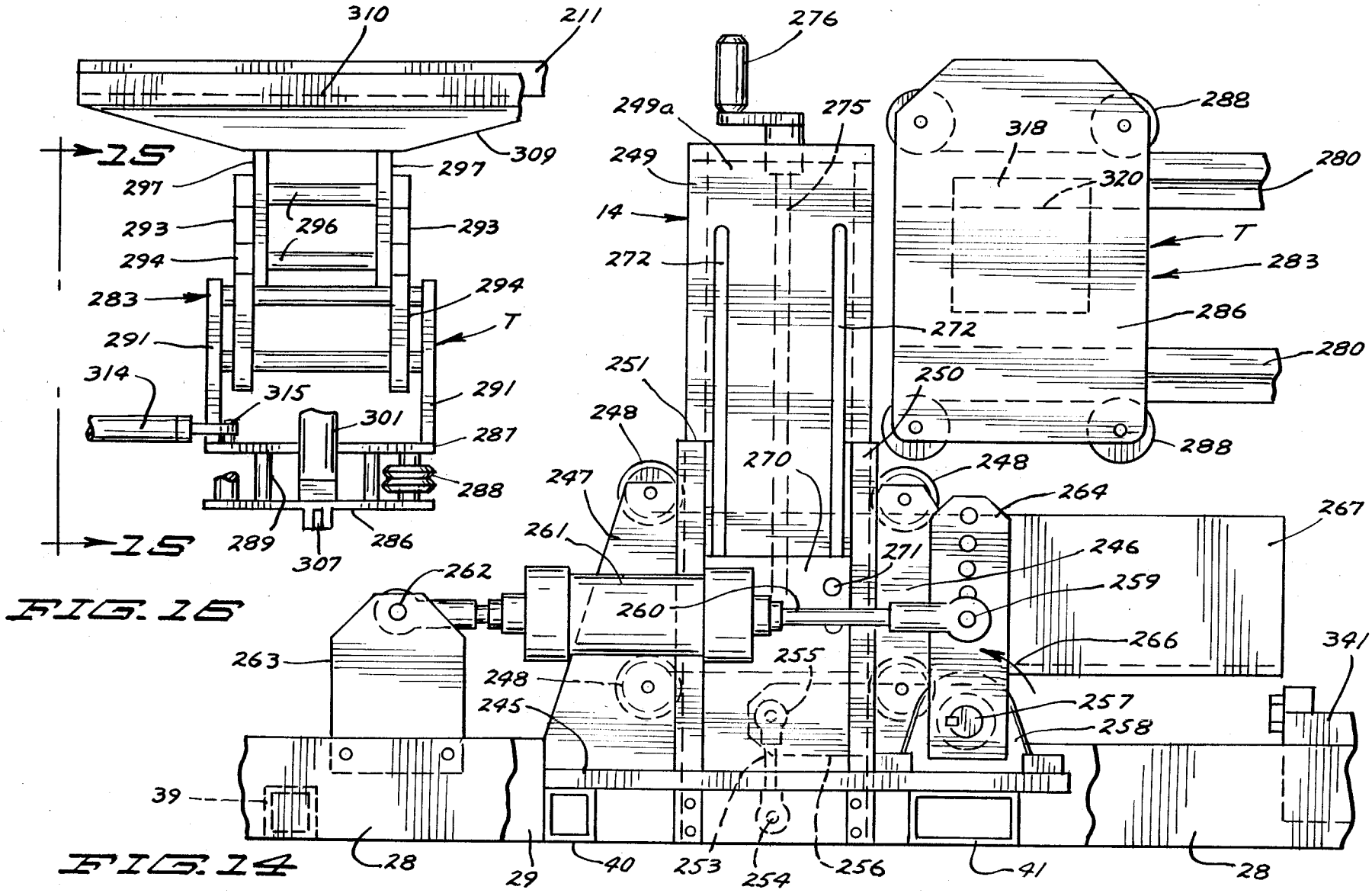
FIGS. 23 and 24 are a schematic showing of the sequencer logic program internal relays.
Figure 7B:
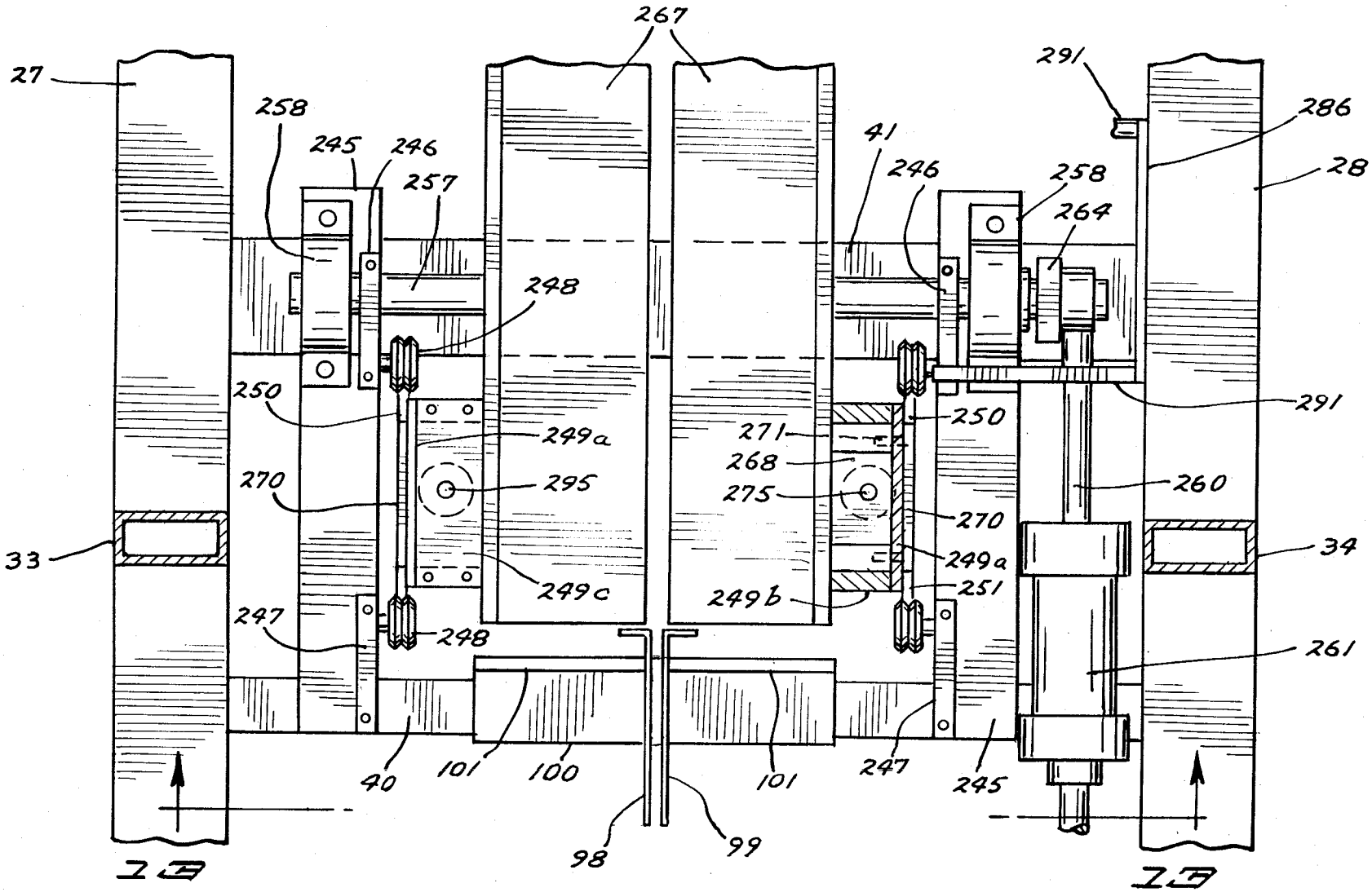
Figures 19, 21:
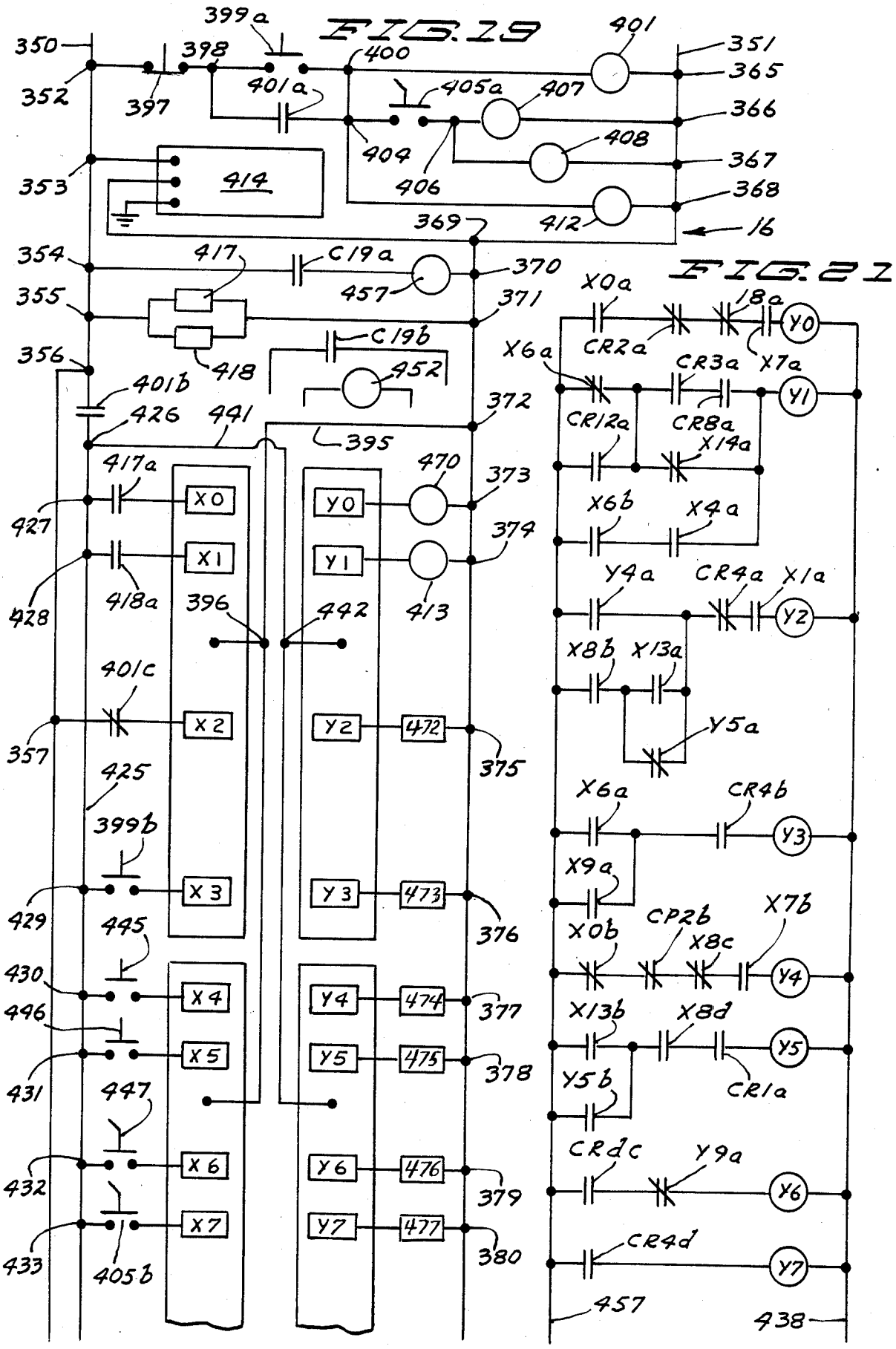
Figure 20:
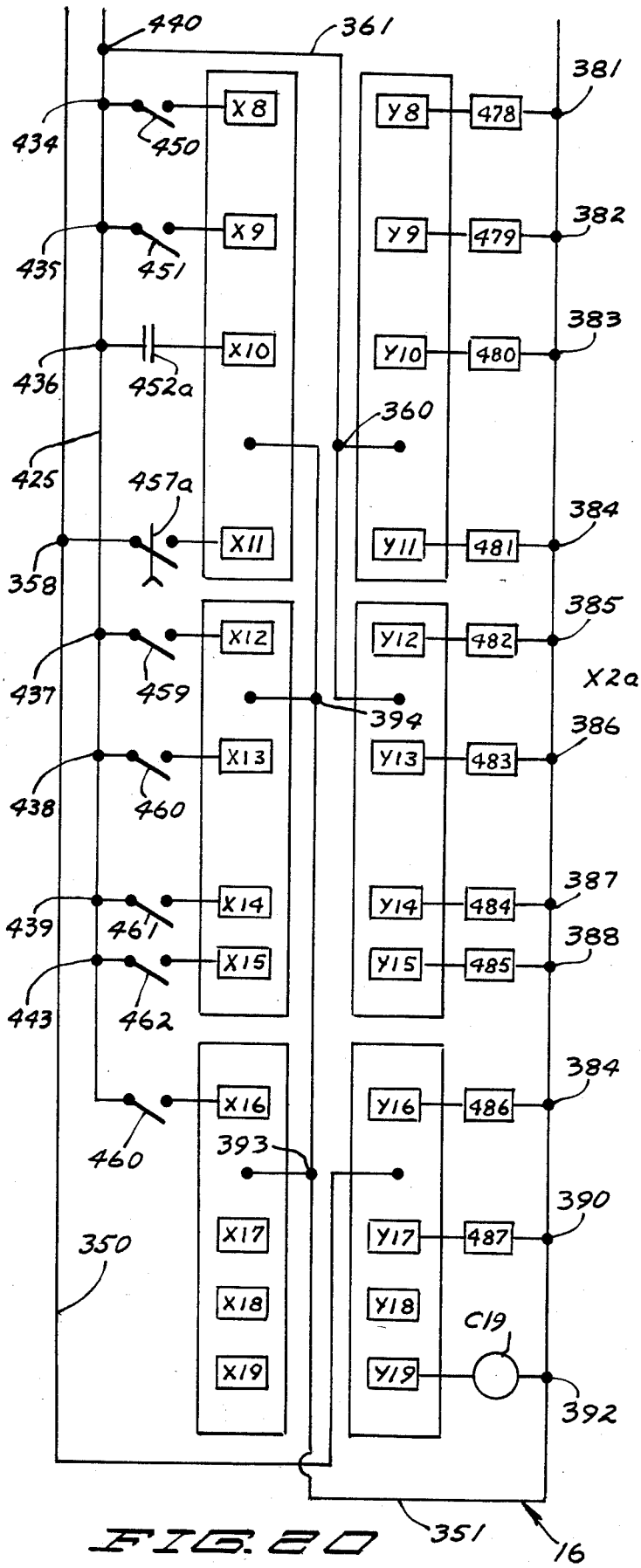
Figure 22:
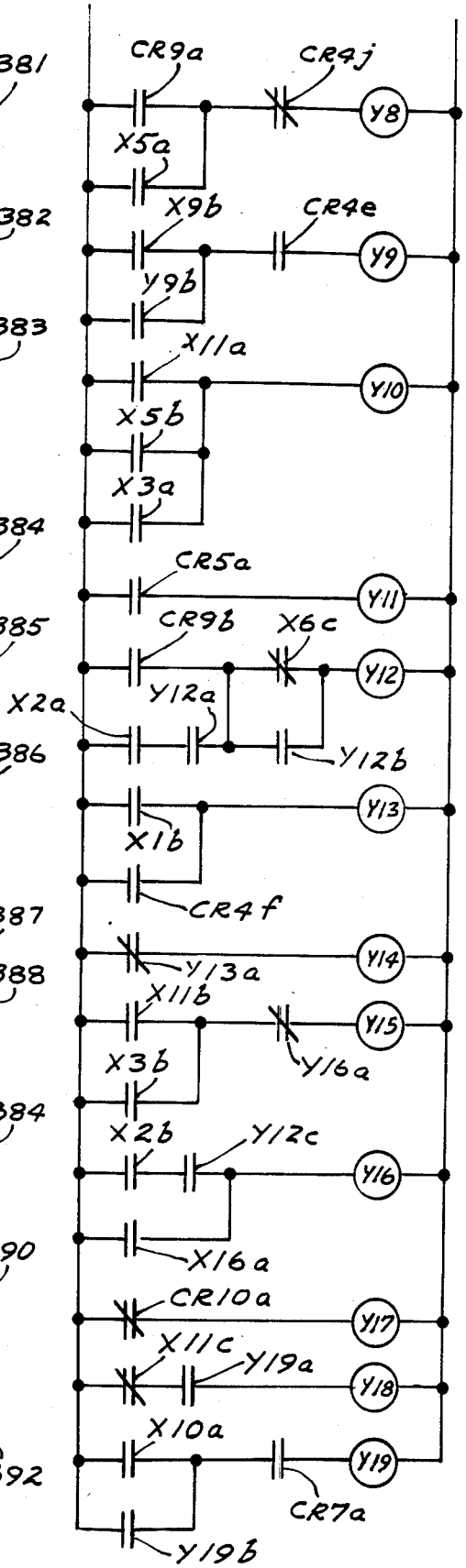
Figure 23:
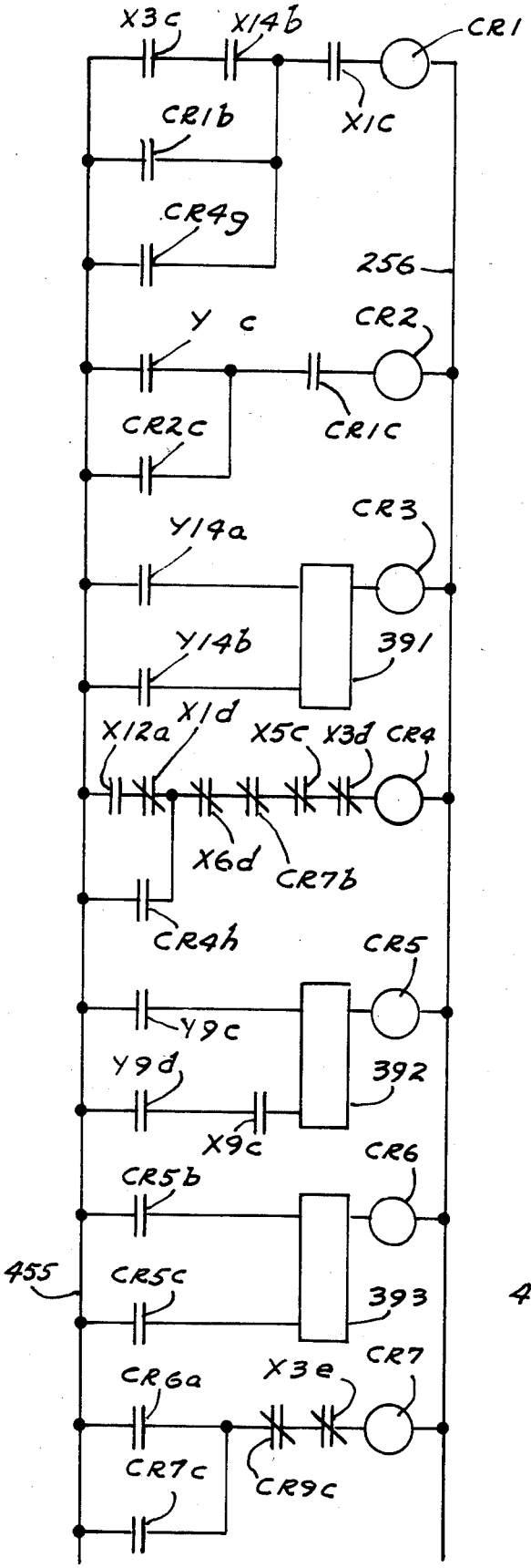
Figure 24:
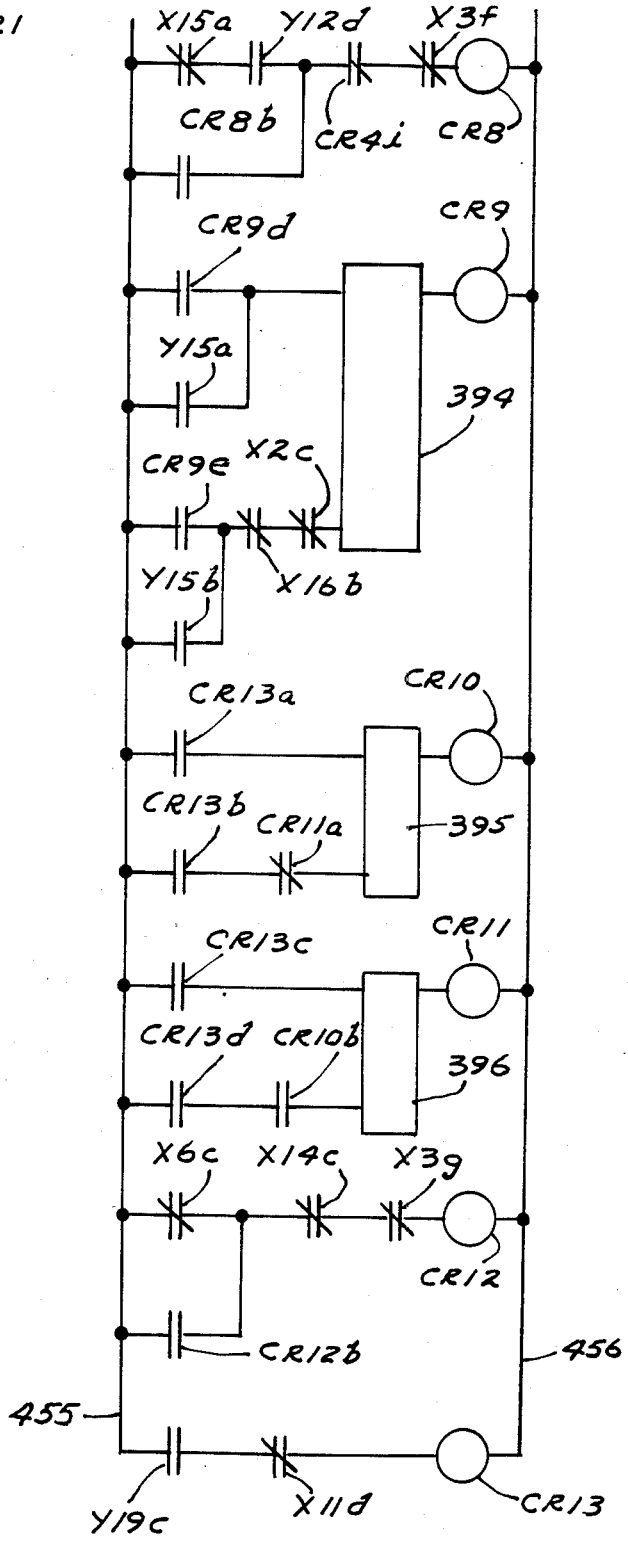

All of the components shown in FIGS. 21 to 24 and all of the components in FIGS. 19 and 20 having a prefix "X" or "Y" are part of the programmed sequence (CPU). FIGS. 23, 24 depict the internal relays of the CPU logic program while FIGS. 21, 22 depict the outputs of the CPU logic program. Since controls other than programmable sequencers can be used to control the machine to function as described, and for purposes of the description of the controls the components in rectangular boxes having a prefix "X" and "Y" respectively will be referred to as an actuator and parts of the circuit in the sequencer controled by the respective actuator will be referred to as a switch member that has the same prefix and number. Further the components in circles having a prefix "Y" will be referred to as an output driver while the components designated by a circle with a reference prefix CR will be referred to as solenoid coils or relays that control circuit parts (switch members) having the same prefix and number designation. When an output driver is energized by a circuit being completed between lines 455, 456 a circuit is provided through the same prefix and number actuator to energize the actuator to operate its switch members and energize the coil of a solenoid controlled valve or coil of a relay exterior of the sequencer.

Each of "X" actuators X0, X1, X3–X10, X12–X16 is connected in series with a switch or switch member across line 425 and line 395 or line 351 with these switches and switch members being exterior of the sequencer while X2, X11 are connected in series with a switch or switch member across line 350 and line 395 or line 351 with the last mentioned switch or switch member being located exterior of the sequencer. When the respective switch or switch member above mentioned in this paragraph is closed or opened to energize or deenergize the respective X actuator the actuator operates its switch members shown in FIGS. 21 to 24, provided power is applied at lines 425, 395, 351, 350.

Each of the actuators Y0–Y17, Y19 is connected in series with the solenoid coil of a relay or a solenoid coil for a solenoid controlled pneumatic valve between line 351 and line 350, 361 or 441 with the solenoid coils being exterior of the sequencer. When the respective output driver is energized, the corresponding actuator completes a circuit to energize the respective solenoid coil and operates its switch members of FIGS. 21–24 between open and closed conditions and when the output driver is deenergized, the solenoid coils are deenergized and its switch members reverse between their open and closed conditions.

Referring to FIG. 19 the switch member 401*b* of the bag opening vacuum motor relay is connected between junctions 356, 426 while switch member 401*c* is connected between junction 357 and the machine reset actuator X2. Actuator X2 has switch members X2*a* and X2*b* that are closed when energized and switch member X2*c* that is opened when energized. The bag in magazine switch member 417*a* is connected between junction 427 and actuator X0 which has switch member X0*a* that is closed when energized and X0*b* that is opened when energized. The bag in positioner switch member 418*a* is connected between junction 428 and actuator X1, X1 having a switch members X1*a*, X1*b*, X1*c* that are closed when energized and X1*d* that is opened when energized.

Machine reset switch member 401*c* is connected in series between junction 357 and actuator X2, X2 having switch member X2*a*, X2*b* that are closed and X2*c* that is opened when X2 is energized. A switch member 399*b* of the machine start switch which is resiliently retained in an open condition is connected in series between actuator X3 and junction 429, X3 having switch members X3*a*, X3*b*, X3*c* that are closed and X3*d*, X3*e*, X3*f*, X3*g* that are opened when X3 is energized. A carriage jog switch 445 that is resiliently retained in an open condition is connected in series between junction 430 and actuator X4, X4 closing its switch member X4*a* when energized. A spout reset switch 446 that is resiliently retained in an open condition is connected in series between junction 431 and actuator X5, X5 having switch members X5*a*, X5*b* that are closed and X5*c* that is opened when X5 is energized.

An auto-manual switch 447 that remains open in an automatic position is in series between junction 432 and actuator X6, X6 having switch members X6*a*, X6*c*, X6*d*, X6*e* that are opened and X6*b* that is closed when X6 is energized. The bag feed on-off switch has a switch member 405*b* that remains in the position it is moved to and is connected in series across junction 433 and actuator X7, X7 having switch members X7*a*, X7*b* that are closed when X7 is energized.

A magazine vacuum switch 450 that is closed by all the pick up cups grippingly engaging a bag on the magazine to prevent air inflow into the cups is connected in series between junction 434 and actuator X8, X8 having switch members X8*a*, X8*c* that are opened and X8*b*, X8*d* that are closed when energized. A bag opening vacuum switch 451 that is closed by all the bag opening cups grippingly engaging the side walls of a bag to prevent air inflow into the cups is connected in series between junction 435 and and actuator X9, X9 having switch members X9*a*, X9*b*, X9*c* that are closed when X9 is energized.

The switch member 452*a* of a scale at weight relay is connected in series between junction 436 and actuator X10, X10 having switch members X10*a* that is closed when X10 is energized. The scale at weight relay includes a solenoid coil 452 in a conventional scale circuit which is energized to close switch member 452*a* when the amount of product in the scale hopper 453 reaches a predetermined weight.

The switch member 457*a* of a bag release timer is connected in series between junction 358 and actuator X11, X11 having switch members X11*a*, X11*b* that are closed when X11 is energized and X11*c*, X11*d* that are opened when energized. Switch member 457*a* is closed a preselected time after the bag release timer coil 457 is energized, coil 457 being connected in series with switch member C19*a* of the scale dump relay C19 across junctions 354, 370.

A bag clamp limit switch 459 that is resiliently retained in an open condition is connected in series between junction 437 and actuator X12, X12 having a switch member X12*a* that is closed when X12 is energized. Switch 459 is closed by and as long as the carriage assembly is above the bag positioner assembly in a position to properly clampingly engage an upright bag in the positioner assembly.

A bag pick up up limit switch 460 is connected is series between junctions 438 and actuator X13, X13 having switch members X13*a*, X13*b* that are closed when X13 is energized. The switch 460 is resiliently retained in an open condition but is closed as long as piston rod 49 of the pick up assembly is retracted. A carriage stop switch 461 that is resiliently retained in an open condition is connected in series across junction 439 and actuator X14, X14 having switch members X14*a*, X14*c* that are opened and X14*c* that is closed when X14 is energized. Switch 461 is closed by and remains closed as long as the carriage assembly is beneath the scale in position for having product dumped thereinto.

A carriage start limit switch 462 is connected between junction 443 and actuator X15, X15 having a switch member X15*a* that is opened when X15 is energized. The carriage start switch is resiliently retained in an open condition and is closed by and remains closed as long as the transfer assembly is in its rear solid line position of FIG. 2 for gripping a bag on the carriage assembly. The bag transfer forward limit switch 463 is connected across junction 443 and actuator X16, X16 having switch member X16*a* that is closed and a switch member X16*b* that is opened when actuator X16 is energized. Switch 463 is closed by the transfer assembly being in its forward dotted line position of FIG. 2.

The solenoid coil 470 of the relay (not shown) for controlling the energization of the motor (not shown) for driving the magazine conveyor is connected between actuator Y0 and junction 473, the motor being energized when coil 470 is energized. The carriage drive solenoid 413 is connected across junction 374 and actuator Y1, solenoid 413 when energized operating a conventional solenoid operated clutch (not shown) of the motor recuder combination 156 to drive the output shaft 158 of said combination and when deenergized discontinue the drive to said output shaft even though the motor of said combination is still energized.

The solenoid coil C19 of the scale dump relay is connected across actuator Y19 and junction 392, Y19 when energized closing switch members Y19*a*, Y19*b*, Y19*c*, and coil C19 when energized closing switch members C19*a*, C19*b*. Switch member C19*b* is in a conventional dump circuit of the scale hopper and when closed and other conitions of the dump circuit are met, result in the scale dumping product into the carriage spout assembly. The dump circuit is conventional.

The solenoid coils 472–486 are between actuators Y2–Y17, Y19 and junctions 373–390 respectively. When the solenoid coils 472, 473 of the solenoid operated magazine vacuum and bag opener vacuum valves are energized vacuum is applied to the bag pick up cups 54 and bag opener cups 215 respectively and to discontinue the application of vacuum when deenergized. Upon energization of the solenoid coil 474 of the bag pick up valve, pressurized air is applied to cylinder 48 to move the vacuum cups 54 from the solid line position of FIG. 3 to position 54*b* and when deenergized to retract the cups; while when the solenoid coil 475 of the bag feed valve is energized, pressurized fluid is applied to cylinder 59 for moving the cups 54 from the solid line position of FIG. 3 to the dotted line position 54*a* for feeding the bottom end of the picked up bag to the entry nip of the feed rolls, and when deenergized to move the cups back to the solid line position.

When the solenoid coil 476 for the valve for applying pressurized fluid to the bag opening cylinder 271 is energized, the bag opening cups 215 are moved from their transversely remotely spaced solid line positions of FIG. 10 to their dotted line adjacent positions. Solenoid coils 477, 478 operate a bag clamp clamp valve 500 (see FIG. 25) which has a valve member that is moved to a position for applying fluid under pressure to the end of clamp cylinders 175 to move clamp member 173 transversely toward clamp members 170 to clamp a bag therebetween when coil 477 is energized and to remain in said position even after coil 477 is deenergized up until coil 478 is energized to move clamp members 173 to their unclamping position of FIG. 12.

Solenoid coils 479, 480 operate a bag clamp in-apart valve 501 in the same manner as the bag clamp clamp valve is operated. When coil 479 is energized the valve member of valve 501 moves to a position for applying fluid under pressure to cylinder 203 for swinging the front and rear clamp assemblies toward one another to their in position provided they are not already in said position; and when coil 480 is energized fluid under pressure is applied to cylinder 203 for moving the clamp assemblies to their apart position and to cylinder 240 to move the spout jaws to their up position.

The solenoid coil 481 of the filling spout jaw down valve 502 when energized moves its valve member to apply pressurized fluid to the end of cylinder 240 for moving the spout jaws to their solid line position of FIG. 11, if not already is such a position, and remains in such a position until coil 480 is energized. As may be noted in FIG. 25, coil 480 controls the application of pilot air to both valves 501, 502 so that when fluid is applied to the end of the valve for moving the clamp assemblies to their apart position, the valve member of the spout jaw down valve is also moved so that pressurized fluid is applied to cylinder 240 for moving the spout jaws to their retracted (up) dotted line position of FIG. 11.

When the solenoid coil 482 of the bag transfer valve is energized fluid under pressurer is applied to cylinder 333 to move the transfer subassemblies from the solid line position of FIG. 2 to their forward dotted line position, and when deenergized to move them back to their retracted solid line position. The solenoid coils 483, 484 for the bag positioner valve 503 when coil 483 is energized apply pilot pressurized fluid to operate the valve for applying fluid to the cylinder 116 to move the pusher member 113 from its dotted line position of FIG. 9 to its solid line position and to the end of cylinder 109 to move the upper part 98*a* of the support member 98 from its vertical position of FIG. 3 to its inclined dotted line position; and when coil 484 is energized to the opposite ends of said cylinders for moving the pusher member and upper part 98*a* back again. It is noted a suitable flow restrictor (not shown) is provided so that part 98*a* is moved to its vertical position prior to the pusher member moving to its dotted line position of FIG. 9 when coil 484 is energized.

Figure 5:
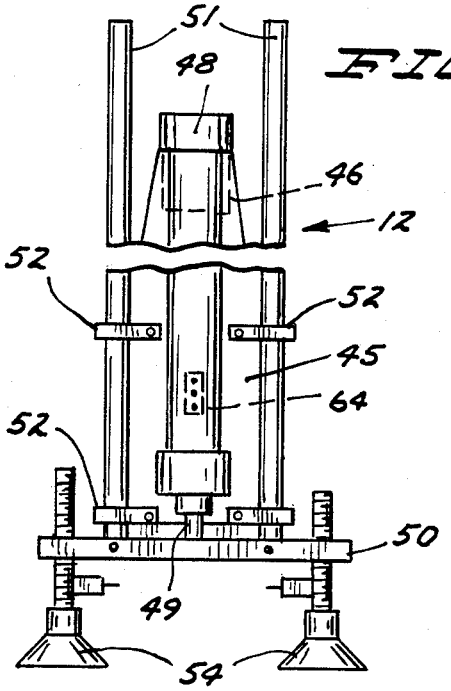
FIG. 5 is a side view of the bag pick up assembly in a bag picked up position, said view being generally taken along the line and in the direction of the arrows 5—5 of FIG. 3.
Figure 6:
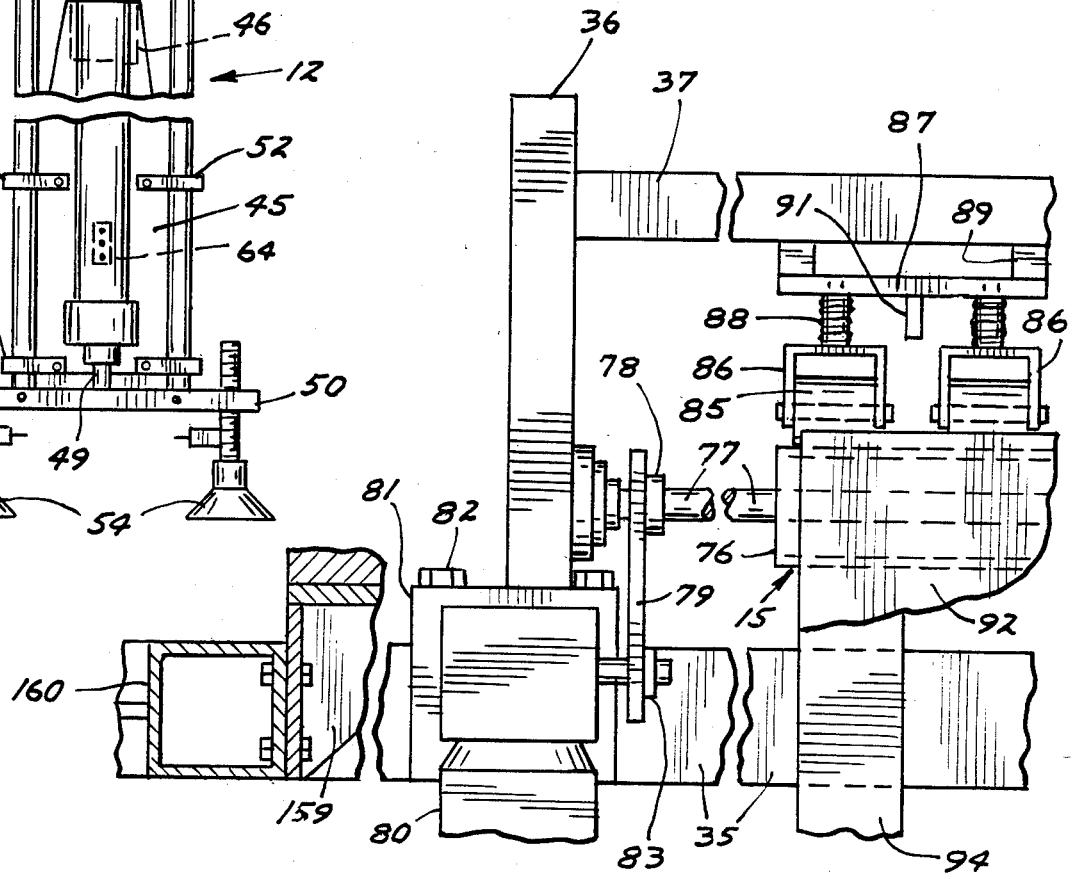
FIG. 6 is a fragmentary side view of the bag feed assembly that is generally taken along the line and in the direction of the arrows 6—6 of FIG. 7.

Solenoid coils 485, 486 control the application of pilot air to the transfer gripper valve 504 which is the same type as the bag clamp clamp valve, coil 485 when energized resulting in applying pressurized fluid to the end of cylinder 301 for moving the gripper parallel arms for their solid line "in" position, of FIGS. 3 and 5, provided they are not already in their in position, and when coil 486 is energized to apply pressurized fluid to the opposite end of the cylinder to transversely move the gripper arms 293, 294 to their dotted line out position of FIG. 15. Thus for each of the bag clamp clamp valve, the bag clamp in-apart valve, the bag positioner valve and the transfer gripper valve, the respective valve member remains in the last position it was moved to by energizing the respective coil until the other one of the two coils for the same valve is energized. As may be noted FIG. 25 is a very simplified showing of the solenoid coil components for supplying pilot air under pressure from lines 506, 507 to the respective end of the valves, and not showing any connection of the respective end of the valve to the exhaust when the coil is deenergized.

The solenoid coil 487 for the bag shaker valve (not shown) when energized moves its valve member to apply pressurized fluid to the end of cylinder 261 to lower the saddle members and when deenergized to apply pressurized fluid to the opposite end of the cylinder to raise the saddle members (for example two inches).

Actuator Y4 when energized closes its switch member Y4*a* while actuator Y5 when energized opens switch member Y5*a* and closes switch members Y5*b*, Y5*c*. Actuator Y6 closes switch member Y6*a* when energized while actuator Y9 when energized opens its switch member Y9*a* and closes its switch members Y9*b*, Y9*c*, Y9*d*.

When actuator Y12 is energized it closes it switch members Y12*a*, Y12*b*, Y12*c*, Y12*d*; while actuator Y13 when energized opens its switch member Y13*a*. Actuator Y14 upon being energized closes its switch members Y14*a*, Y14*b* while actuator Y15 upon being energized closes its switch members Y15*a*, Y15*b*. Actuator Y16 upon being energized opens its switch member Y16*a*. Actuator Y19 when energized closes its switch members Y19*a*, Y19*b*, Y19*c*.

Referring to FIGS. 23, 24 the logic program includes internal relays having logic that will be referred to as relays CR1–CR13 and times 391–396. The bag feed relay coil CR1 when energized closes its switch members CR1*a*, CR1*b*, CR1*c* while the bag feed relay coil CR2 when energized opens switch members CR2*a*, CR2*b* and closes switch member CR2*c*. The solenoid coil CR3 and timer 391 are connected across lines 455, 456, coil CR3 when energized at the end of the timing cycle closing its switch member CR3*a*. The relay CR4 when energized opens its switch members CR4*a*, CR4*i*, CR4*j* and closes its switch members CR4*b* through CR4*h*. Spout relay CR5 and timer 392 are connected across lines 455, 456, relay CR5 when energized at the end of the timing cycle closing its switch members CR5*a*–CR5*c*.

A vacuum check relay CR6 and timer 393 are connected in a circuit across lines 455, 456, relay CR6 when energized at the end of the timing cycle closing its switch member CR6*a*, while the dump relay CR7 when energized closes it switch members CR7*a*, CR7*c* and opens its switch member CR7*b*. The carriage start relay CR8 when energized closes it switch members CR8*a*, CR8*b*. The bag transfer relay CR9 and timer 394 are connected across lines 455, 456, relay CR9 when energized at the end of the timing cycle closing its switch members CR9*a*, CR9*b*, CR9*d*, CR9*e* and opening its switch member CR9*c*.

The shaker relay CR10 and timer 395 are connected in a circuit across lines 455, 456 as is shaker relay CR11 and timer 396. Relay CR10 when energized at the end of the timing cycle opens it switch member CR10*a* and closes switch member CR10*b*, while relay CR11 when energized opens its switch member CR11*a*. The carriage holding relay CR12 when energized closes its switch members CR13*a*–CR13*b*.

With reference to the operation of the machine, assuming the machine has been turned off and no power is applied to lines 350, 351, now fluid under pressure is applied for the valves. Since valve coils 474, 475 are not energized the piston rod 49 for the pick up cups is retracted and the piston rod 58 moves to its extended position whereby the pick up cups 54 are in the solid line position of FIG. 3 and limit switch 460 is thereby closed. Further since the coil 482 of the bag transfer valve is not energized the transfer assembly is moved to it rearward solid line position of FIG. 2; the coil 487 of the shaker valve is not energized whereby the piston rod 260 is extended so that the saddle members are in their solid line elevated position of FIG. 14; and the bag opening cups 215 are in their retracted positions.

Upon application of power to lines 350, 351 the sequencer 414, actuator X2 and output driver Y14 are energized and the carriage holding relay is energized if the carriage assembly is not under the scale hopper in position to receive product therefrom. Energizing output driver Y14 completes a circuit to energize actuator Y14 so that the support member upper part 98*a* is moved to its vertical position and the pusher 113 is moved to its forward position; and the timer 391, bag positioner relay CR3 is energized. The carriage holding relay CR12 is energized to energize output driver Y1, but since switch member 401*b* is open actuator Y12 is not yet energized and the output shaft 158 of the carriage motor reducer combination is not driven.

With the auto-manual switch 447 in the "auto" open position and the bag feed switch 405*a*, 405*b* closed, the machine start switch is depressed whereby switch member 399*a* completes a circuit to energize the coil 401 of the bag opening vacuum motor relay. This relay moves its switch member 401*a* to provide a hold-in circuit. As a result relay coil 401 remains energized as do the relays for the magazine vacuum motor, the bag feed motor and the carriage drive motor even though switch member 339*a* resiliently moves to its open position.

The energization of coil 401 also resuts in switch member 401*c* opening to deenergize actuator X2 and the closing of switch member 401*b* to apply power to lines 425, 441, 361. Since output driver Y1 is energized, assuing the carriage assembly is not under the hopper scale, the solenoid coil 413 is energized whereby the carriage motor reducer combination output shaft is driven to move the carriage assembly beneath the hopper scale where it closes limit switch 461. This energizes actuator X14 which opens switch member X14*c* to deenergize the carriage holding relay CR12 and open the circuit for energizing the solenoid 413 to discontinue the drive to the output shaft.

The energizing of coil 401 also resulted in switch member 401*c* opening to deenergize actuator X2. If at this time no bag is in a position abutting against the stop plate 68, photo cell unit 417 closes its switch member 417*a* to energize actuator X0 whereby a circuit is completed through output driver Y0 to energize the magazine motor for driving the magazine conveyor to move a stack of bags to abut against the stop plate, and thereupon switch member 417*a* opens and the magazine motor is deenergized. Switch member 417*a* opening deenergizes actuator X0 to close switch member X0*b* which energizes output driver Y4.

During the time the machine start switch was held closed, its switch member 399*b* completed a circuit to energized actuator X3 whereby output driver Y10 is energized to completeaa circuit energize solenoid coil 410. This results in pressurized fluid being applied to cylinders 203, 240 respectively for moving the bag clamp subassemblies longitudinally to their apart position and the spout jaws to their dotted line up position of FIG. 11. Also output driver Y15 is energized whereby coil 485 is energized to maintain or move the transfer grippers to their solid line "in" position of FIG. 13 and energize the bag transfer relay CR9. Further assuming no bag is in the positioner assembly, switch member X1*c* is closed and since the carriage assembly is under the scale hopper, bag feed relay CR1 is energized as limit switch 461 is closed and remains energized through switch member CR4*g* until switch member X1*c* opens as a result of a bag bottoming in the positioner assembly. While switch member 399*b* is held closed, dump relay coil CR7 and carriage start relay coil are deenergized, if energized, and break their hold in circuits. When switch member 399*b* is released, output drivers Y10 and Y15 are deenergized.

Since X0*b* closed after the stack of bags abutted against the stop plate and output driver Y4 was energized to close Y4*a* to energize output driver Y2 and energize coil 472 to apply vacuum to the pick up cups, coil 474 of the bag pick up valve was energized to extend the vacuum cups 54 to grippingly engage the bottom part of the top bag on the magazine conveyor. When the bag is grippingly engaged the magazine vacuum switch 450 closes to energize actuator X8. As piston rod 49 was extended to lower the vacuum cups 54, limit switch 460 opened to deenergize actuator X3.

The closing of the magazine vacuum switch 450 energizes actuator X8 to close switch member X8*b* to maintain output driver Y2 energized even though switch member Y4*a* subsequently opens, to open switch member X8*c* to deenergize output driver Y4 and thereby the coil 474 whereupon the pick up cups are retracted toward their solid line position of FIG. 3, and close switch member X8*d*. As soon as the cups are retracted to their solid line position limit switch 460 is closed to energize actuator X13 which closes its switch member X13*b*. This completes a circuit to energize output driver Y5. Not previously mentioned is that with actuator X1 energized, switch member X1*b* was closed to energize output driver Y13 so that coil 483 was energized to operate cylinders 109, 116 for moving the bag support upper part to its inclined position and the pusher member to its rearward position. Thus when output driver Y5 was energized piston rod 58 retracted and thereby moved the pick up cups to position 54*a* so that the bag is fed into the entry nip of the feed rollers. Since output driver Y4 and actuator X13 are now deenergized and output driver Y5 is energized, output driver Y2 is deenergized to deenergize coil 472 of the magazine vacuum valve and magazine vacuum switch 450 opens to deenergize actuator X8. Actuator X8 in being deenergized results in output driver Y5 being deenergized and thereby the coil 475 of the bag feed valve whereupon the vacuum cups return to their datum position and limit switch 460 is closed to energize actuator X13.

The picked up bag is fed by the feed rolls to have its bottom end directed downwardly by baffle 92 and slides over slide 94 and the inclined support member part 98*a* to have the bag bottom edge engage bag bottom support 102. Since support 102 is located forwardly of the center of gravity of the bag, the bag pivots in the direction of arrow 132 about support 102 to its inclined position. The bag in abutting against support 102 breaks the beam of light of photo cell unit 418 to deenergize actuator X1.

Actuator X1 in being deenergized deenergizes output driver Y13 whereby valve coil 483 is deenergized and switch member Y13*a* closes to energize output driver Y14. This results in the coil 484 of the bag positioner valve 503 being energized to supply pressurized fluid to cylinder 109 for moving the upper support part 98*a* to its vertical position and cylinder 116 for moving the pusher 113 to its retracted dotted line position of FIGS. 1 and 3. Due to a flow restrictor (not shown) in the fluid circuit for applying fluid to cylinder 116, the support part 98*a* is moved to its vertical position before the pusher member is moved to its forward position.

It is noted that due to the spacing of the lower edge of the slide surface of slide 94 from support member 99 when the bag slides downwardly over the slide initially engages the bag bottom support 102, the upper portion of the bag is inclined upwardly and transversely away from support member 99. However even though the bag pivots about the support 102 as previously described, the upper part of the pusher member portion 113*a* extends sufficiently transversely toward the magazine that even if the bag upper portion is transversely inclined, it will abut against portion 113*a* to limit its upward and rearward inclination. Further portion 98*c* limits the amount of upward and transverse inclination of the bag upper portion as the bag pivots about support 102 to also become inclined upwardly and rearwardly. When the upper part 98*a* is moved to its vertical position it causes the upper portion of the bag to extend substantially vertically.

As the pusher member moves to its forward position the bag in the positioner assembly is moved forwardly and to an upright (non-inclined) position, but not sufficiently forwardly that the bag center of gravity is forwardly of the bag bottom support.

Output driver Y14 in being energized also energizes timer 391 and coil CR3 of the bag positioner relay to maintain its switch member open for a predetermined period of time. Than CR3*a* is closed. Switch member CR8*a* was closed prior to CR3*a* being closed in that at the time the machine start switch was held closed, if the transfer grippers were in their out position, switch member Y16*a* was closed and the closing of switch member X3*b* resulting from actuator X3 being energized energized output driver Y15. With driver Y15 energized solenoid coil 485 was energized whereby the valve member of the transfer gripper valve 504 was moved to apply and maintain fluid under pressure to move the grippers transversely to their in position. Also the energization of actuator Y15 resulted in the switch members Y15*a*, Y15*b* closing to energize coil CR9 of the bag transfer relay. This results in switch member CR9*b* closing to energize the output driver Y12 whereby coil 492 is energized and fluid under pressure is applied to cylinder 333 to move the transfer subassemblies forwardly, the time delay of timer 394 controlling the period of time before which the transfer subassemblies move forwardly.

At the time the bag transfer subassemblies were moving forwardly, limit switch 462 opened to deenergize actuator X15 which opens switch member X15*a*, and with output driver Y12 being energized switch member Y12*d* closes to energize the carriage start relay CR8 to close switch member CR8*a*.

With switch members CR3*a*, CR8*a* closed, output driver Y1 is energized whereby the output shaft of the carriage motor reducer combination is driven to move the carriage assembly rearwardly. This opens the carriage stop limit switch 461 to deenergize actuator X14 which closes its switch members X14*a* whereby the output shaft is continuously driven until the carriage assembly again moves under the scale hopper. Due to the crank arm extending horizontal when the carriage assembly is beneath the scale hopper and also when it is in its rearwardmost position above the positioner assembly, the movement of the carriage assembly when horizontally adjacent the positioner assembly is very slow. At the time the carriage assembly has moved rearwardly adjacent the positioner assembly it closes bag clamp limit switch 459 to energize actuator X12 and through switch member X12*a* closing energizes the bag opening relay CR4. This results in coil 477 of the bag clamp valve 500 being energized so that fluid is applied to cylinders 175 for transversely moving bag clamp members 173 to clamp the upper leading and trailing edge portions of the bag 20*b* in the positioner assembly against members 170 (see dotted line position of clamp members 170 on FIGS. 1 and 2).

Relay CR4 in being energized, through switch member CR4*i* opening, deenergizes the carriage start relay CR8; through CR4*c* closing energizes output driver Y6 whereupon coil 476 is energizes so that the bag opening vacuum cups are moved transversely toward one another and output driver Y3 is energized so that coil 473 is energized for applying vacuum to these cups.

Upon all the bag opening cups engaging the opposite side walls of the bag longitudinally between the clamp assemblies 164, 165, vacuum switch 451 closes to energize output driver X9 which results in coil 479 being energized to move the valve member of the bag clamp valve 501 whereby the clamp assemblies are moved longitudinally to their dotted line in position of FIG. 11, switch member Y9*a* opening to deenergize coil 476 and the bag opening cups moving apart to open the bag mouth, and the spout relay CR5 and timer 392 being energized. It is to be noted prior to the bag opening cups being moved transversely away from one another to open the bag mouth, the carriage assembly has moved the clamped bag to be entirely forwardly of the positioner assembly and that as the carriage assembly moves forwardly the bag clamp limit switch 459 opens.

Coil CR5 of the spout rely in being energized and after a preselected time delay moves its switch member CR5*a* to energize output driver Y11 whereby the spout jaws 224, 223 move downwardly into the bag mouth portion of the opened bag clamped on the carriage assembly; it being noted that if there is air inflow through one of the bag opening cups, due to the provision of switch member X9*c* the spout relay does not operate its switch members whereby the spout jaws go down from their dotted line position of FIG. 11. Spout relay switch members CR5*b*, CR5*c* in closing energize the vacuum check relay timer circuit whereby after a time delay coil CR6 closes it switch member CR6*a* to energize the dump relay CR7, provided the bag transfer relay switch member CR9*c* is closed. It is noted the bag transfer relay CR9 is deenergized when the transfer subassemblies closed switch member 463 to energize actuator X16 while the carriage assembly in moving back under the scale hopper closes limit switch 461 whereupon swtich member X14*a* opens and the forward movement of the carriage assembly stops.

At the time coil 482 of the transfer valve was energized, the carriage start limit switch 462 opened to deenergize actuator X15 and thereby open switch member X15*a*, and upon the transfer subassemblies moving to their forwardmost position, limit switch 463 was closed to energize actuator X16 and thereby open switch member X16*b* in the circuit for timer 394 and closes X16*a* to energize output driver Y16 so that pressurized fluid is applied to cylinders 301 to move the grippers transversely apart to their bag release position. At the time the bag transfer rely was deenergized its switch member CR9*b* opened so that the coil 482 of the bag transfer valve was deenergized and the application of pressurized fluid to cylinder 333 was discontinued. As a result the transfer subassemblies were retracted. This opened the limit switch 463 and switch member X16*b* closed.

When the dump relay CR7 was energized, output driver Y19 is energized, provided actuator X10 is energized. Actuator X10 is energized as soon as switch member 452*a* is closedy by relay C10 being energized when the scale hopper contains the desired weight of product. Output driver Y19 in being energized results in relay coil C19 closing switch member C19*a* to through the scale dump discharge product to fall through the carriage assembly spout into the clamped bag and energized bag release timer 457. At the same time switch member Y19*c* closes to energize coil CR13 of the shaker start relay which closes switch members CR13*a–CR13d* whereby coil CR10, timer 395 are energized to open switch member CR10*b* for deenergizing actuator Y17. With actuator Y17 deenergized, piston rod 260*a* retracts and thereby pivots shaft 257 in the direction of arrow 266 for lowering the saddle membes a short distance from the solid line position of FIG. 14, close CR10*b* to energize timer 396, coil CR11 to open CR11*a* whereby switch member CR10*a* closes and the saddle members suddenly moves upwardly to shake (jolt) the bag when it is partially filled and then CR11*a* opens so that the saddle members are again lowered. This sudden motion results in product settling and filling out the lower portion of the bag, and is particularly advantageous where some bags, such as pinch bottom bags, do not always have their bottom part completely opened during the filling operation without such movement. The number of upward jolts of the saddle members is determined by the setting of timers 395, 396 and the length of time required to fill the bag.

When the bag release timer times out, which period of time is sufficiently long to insure all the product is dumped into the clamped bag, it closes its member 457*a* for a short period of time to energize actuator X11 which closes switch member 11*a* to energize output driver Y10 so that coil 480 is energized. As a result the spout jaws are moved up and the bag clamps are moved to their longitudinally apart position. Switch member 11*b* is closed to energize coil 485 so that the the transfer grippers move transversely to their in position for gripping opposite bag side walls after the clamp subassemblies have moved to their apart position. With Y15 energized switch members Y15*c*, Y15*b* close for energizing the bag transfer relay CR9. Relay CR9 at the end of a time delay, provided switch member X2*c* is closed, energizes output driver Y12 so that the transfer subassemblies are moved forward as previously described. That is at the time the transfer grippers moved to their in position to grippingly engage the filled bag switch member CR9*b* was closed and bag transfer valve coil 482 energized so that the transfer subassemblies moved forwardly to suspendingly carry the filled bag to the conveyor assembly at the discharge station and to release the filled bag at the time actuator Y16 was energized as previously described.

At the time dump relay CR7 was energized it opened switch member CR7*b* to deenergize the bag opening relay coil CR4 to through CR4*b* opening deenergize output driver Y3 to discontinue the application of vacuum to the vacuum opening cups, and through CR4*j* energize output driver Y8 so that if the bag transfer relay CR9 is energized, actuator X8 is energized and then the clamp members 173 are transversely retracted to their unclamping position after the filled bag is gripped by the upper and lower grippers. Thus the clamp assemblies release the filled bag at the time actuator Y16 is energized as previously described.

During the time the carriage assembly was moving rearwardly switch members X12*a*, X1*c* were open. Accordingly relays CR1, CR4 were deenergized and actuator Y4 was energized so that switch member Y4*a* closed. Then the cups 54 moved downwardly to engage the top bag on stack S, and switch member 460 opened to deenergize actuator X13. Since a bag was still in the positioner assembly switch X1*a* was closed and upon relay CR4 being energized due to the carriage assembly closing switch member X12*a* when the assembly was over the positioner assembly, switch member CR4*g* closed. As the carriage moves the bag clampd thereto away from the positioner assembly actuator X1 is energized and switch member X1*c* closes to energize relay CR1 and through switch member CR1*b* remains energized until another bag is feed into the positioner assembly.

After the carriage assembly has moved the bag clamped thereto to be entirely forwardly of the positioner assembly and the dump relay CR4 is energized, switch member CR7*b* opens to deenergize the bag opening relay CR4. Relay CR4 in being deenergized closes switch member CR4*a* whereupon coil 472 is energized and a vacuum is applied to the pick up cups. The vacuum switch 450 closes due the top bag on the stack S being gripped, and switch member X8*c* opens so that the pick up cups are vertically retracted to close switch 460. Since switch members X13*b*, X8*d*, CR1*a* are now closed actuator Y5 is energized and the piston rod 58 is retracted whereby the picked up bag is fed to the feed rolls. Switch member Y5*c* closes to energize bag feeding relay CR2 and retains it energized until the picked up bag is fed into the positioner assembly. The cycle of feeding the bag continues as previously described. It is beleived the operation of the controls has been sufficiently described to understand the operation of the machine, and that on the basis of the description and the showing of the controls it will be obvious to one skilled in the art a number of the features of the controls have not been set forth, for example preventing various operations taking place while other operations are occuring.

The mechanism of this invention is used with bags that are of sufficient rigidity that their top portions will extend substantially upright above the positioner support members to be clamped as described. Further the bags are picked up by cups 54 adjacent to their botton flat folded edges (remote from the peripheral edge defining the bag mouth) and are fed with their bag mouth edge trailing their bottom edge so that the bottom edge falls to engage the support member 102. Additionally the members that clamping engage the trailing and leading top side edge portions of the bag in the positioner assembly when in an upright condition, remain in clamping engagement with said edge portions up until after the bag is filled and the bag is grippingly engaged by the upper and lower grippers, there being no other clamp mechanism on the carriage assembly for clampingly engaging the bag nor any clamp mechanism to clamp the bag side walls against the carriage spout.

Further after the bag is filled the clamp members are moved to their apart condition to close the bag mouth before the bag top portion is grippingly engaged by the upper gripper members to hold the bag top closed. The upper and lower grippers grip the bag to suspendingly carry it (without the bag bottom being supported) from the filling station to the discharge station and then release the filled bag so the bag bottom will move downwardly to be supported by the lower horizontal endless conveyor. Even though this machine can be used for filling both gussetted and non gussetted bags, it is particularly adapted for filling pinch bottom bags that are hard to handle.

The machine can be used for filling bags of sizes for holding, for example, 25 or 50 pounds of product such as dog food or sugar. Additionally the machine incorporates various adjustable features, only some of which have been described, so that it can be used for filling various size bags. For example one embodiment of the invention may be used for filling bags that in their flat folded condition are of widths between about 14" to 19" and of lengths of about 26" to 37".

What is claimed is:

1. In apparatus for feeding a flat folded bag having opposite side walls, a top peripheral edge defining a bag mouth, a bottom edge, a leading edge and a trailing edge from a bag magazine and moving the bag to a filling station, a longitudinally elongated frame having a front end and a rear end, a bag positioner assembly mounted on the frame for supporting a flat folded bag with the top edge at a higher elevation than the bottom edge that includes transversely spaced first and second bag side wall support members for having a flat folded bag fed therebetween, first means for for limiting the downward movement of the flat bag between the side wall supports and abutting against the bag bottom edge so that the bag is inclined forwardly in a downward direction, and operable second means movable between a first position extending rearwardly of the side wall support members to limit the angle of inclination of the flat bag when it abuts against the first means and a second position straightening the flat bag to extend vertically upright between the side wall support members, operable third means for removing a flat folded bag from the magazine and feeding the bag to move downwardly between the side wall support members to have the bag bottom edge engage the first means, a carriage assembly mounted on the frame for clampingly engaging the bag in its upright position and moving the bag from the positioner assembly to a bag filling station, and control means for operating the operable means.

2. The apparatus of claim 1 further characterized in that the carriage assembly includes a carriage, first and second operable bag clamp means mounted on the carriage for movement therewith and relative thereto for clampingly engaging the bag side walls adjacent the bag to and the trailing and leading edges respectively when the bag is in an upright condition between the support members, and releasing the clamped bag at the filling station after it has been filled, operable first and second vacuum cup means for grippingly engaging the first and second bag side wall of the clampingly engaged bag and opening the bag mouth prior to filling the clamped bag and releasing the clamped bag after it is filled, spout mechanism mounted on the carriage for directing product into the opened bag, and means for mounting and moving the carriage between a position for the bag clamp means to clamping engage a bag in an upright position in the positioner assembly and a filled bag release position at the filling station, the control means including means for operating the bag clamp means to clampingly engage the upright bag, then the first and second clamp means to move toward one another and the vacuum cup means to open the bag mouth, and after the clamped bag is filled operate the vacuum cup means to release the bag grippingly engaged thereby, thence the bag first and second bag clamp means apart from one another to close the opened bag mouth and thereafter the bag clamp means to release the clampingly engaged bag.

3. The apparatus of claim 1 further characterized wherein there is provided a combination saddle and shaker assembly on the frame at the filling station for cooperating with the carriage assembly to support the clamped bag and shake the bag as it is being filled.

4. The apparatus of claim 1 further characterized in that the carriage assembly includes first clamp means for clampingly engaging the bag side walls adjacent the bag top and trailing edge, second clamp means for clampingly engaging the bag side walls adjacent the bag top and leading edge, operative means for mounting and operating the clamp means to a bag clamping position to clampingly support a bag that is in an upright position in the positioner assembly and thence move the first and second clamp means toward one another, and after the clamped bag has been moved to the filling station and been filled, move the first and second clamp means away from one another to close the bag mouth and thereafter to release the clamped bag.

5. The apparatus of claim 4 wherein there is a filled bag discharge station remote from the filling station, further characterized in that there is provided a transfer assembly mounted on the frame for gripping the filled bag after the first and second clamp means has moved apart and prior to releasing the filled bag and after the bag is released by the clamp means suspendingly carrying the filled bag from the filling station to the discharge station.

6. The apparatus of claim 5 wherein the discharge station is located longitudinally forwardly of the filling station, further characterized in that the transfer assembly includes first and second longitudinally elongated upper gripper means for engaging the opposite side walls of the filled bag at an elevation below the clamp means for holding the filled bag in a closed condition and partially supporting the filled bag, first and second lower gripper means for engaging the opposite side walls of the filled bag vertically intermediate the filled bag bottom and the upper gripper means to in cooperatiion therewith supportingly suspend the filled bag after the filled bag is released by the clamp means, operable gripper mounting means for relatively moving the first upper and lower gripper means and the second upper and lower gripper means between a first position that the first and second upper and lower gripper means are remotely spaced from one another and a second position for supportingly engaging the filled bag, and means for mounting and moving the operable gripper mounting means between the filling station and the discharge station, the control means including means for controlling the operation of the upper and lower gripper means to move them from their second position to their first position to grip a filled bag before it is released by the clamp means and then the operable gripper mounting means to move the upper and lower gripper means from the filling station to the discharge station after the filled bag is released by the clamp means.

7. The apparatus of claim 1 wherein the flat folded bags are vertically stacked on the magazine with their bottom edges more closely adjacent the bag positioner assembly than their top edges and transversely offset therefrom, further characterized in that the third means includes operable bag pick up means for removing the top bag from the stacked bags on the magazine and feeding it toward the bag positioner assembly, and fourth means for receiving the picked up bag and directing the picked up bag between the side wall support members.

8. The apparatus of claim 7 further characterized in that the second means includes an elongated vertical pusher member and operable means for mounting and moving the pusher member to move the inclined bag to an upright position and move it forwardly a limited distance and retain it in an upright position as it is supported by the first means.

9. The apparatus of claim 7 further characterized in that the first side wall support member is located transversely between the pick up means and the second side wall support member and at a lower elevation than the pick up means, the first support member including a lower vertical part having a top edge portion, an upper part having a lower portion, and means for connecting top edge portion and lower portion together to mount the upper part for pivotal movement about a transverse axis between a first position inclined upwardly in a transverse direction generally toward the pick up means and a vertical upright second position, and operable fifth means for moving the upper part between its positions, the control means including means for operating the fifth means to move the upper part to its first position before the fourth means directs a picked up bag to move between the support members, and after the picked up bag moves between the support members but before the bag between the support members is moved to its upright position, move the upper part to its second position.

10. The apparatus of claim 9 further characterized in that the fourth means includes a pair of feed rollers for receiving a bag from the pick up means and moving the picked up bag transversely toward the support members and baffle means for directing the bag being fed by the feed rollers downwardly toward the upper part in its first position to move thereover and thence between the lower part and the first support member.

11. In apparatus for feeding a flat folded bag having opposite side walls, a top peripheral edge defining a bag mouth, a bottom, a leading edge and a trailing edge from a bag magazine and moving the bag to a filling station and thence to a discharge station horizontally spaced from the filling station, a longitudinally elongated frame having a front end and a rear end, a carriage assembly having a spout and first means for clampingly engaging a flat folded bag, opening the bag mouth, holding the open bag to have product discharged through the spout to fill the clamped open bag at the filling station, thence close the filled bag, and thereafter release the closed filled bag, and a transfer assembly mounted on the frame for grippingly engaging the filled bag before it is released by the first means and thereafter retain the filled bag in a closed condition and suspendingly carry the filled bag from the filling station to the discharge station, the transfer assembly including first and second upper grippers movable between a first position for grippingly engaging the bag side walls between the level of product in the filled bag and the bag top edge to partially support the filled bag after it is released by the first means and a second position transversely spaced from and on opposite transverse sides of the clamped bag at the filling station, first and second lower grippers movable between a first position for grippingly engaging the bag side walls vertically intermediate the upper grippers and the bag bottom of the filled bag to in cooperation with the upper grippers suspendingly support the filled bag after it has been released by first means and a second position transversely spaced from and on opposite transverse sides of the clamped bag at the filling station, operable second means for mounting and moving the upper and lower grippers between their positions, and operable third means mounted on the frame for mounting and moving the second means between the filling station and the discharge station, and operable fourth means for removing a flat folded bag from the magazine and positioning the bag in a position to be clampingly engaged by the first means, control means for operating the operable means, including the second means to move the grippers to their first position prior to the filled bag being released by the first means and to their second position after the third means has been moved from the filling station to the discharge station, and the third means to move the second means from the filling station to the discharge station after the first means has released the filled bag and the grippers are in their first position and means for mounting the carriage assembly on the frame.

12. The apparatus of claim 11 further characterized in that the operable second means includes gripper arm fifth means for mounting the first grippers, gripper arm sixth means for mounting the second grippers, transversely spaced first and second gripper gripper arm mounting means for mounting the fifth and sixth means respectively and for moving the grippers transversely between their positions, and that the third means includes seventh and eighth means on the frame for mounting the first and second gripper arm mounting means for movement between the filling and discharge stations, and operable means of the frame for moving the seventh and eighth means between the filling and discharge stations.

13. The apparatus of claim 12 further characterized in that each of the arm means includes a pair of parallel arms having upper and lower end portions and a horizontal arm pivotally connected to the parallel arm upper end portions and mounting the respective upper gripper, and that the seventh and eighth means each includes means for mounting the respective pair of parallel arm lower end portions for pivotal movement about longitudinal pivot axes, and operable means connected to the respective pair of parallel arms for moving the parallel arms and therethrough the horizontal arm to move the respective upper gripper between its first and second positions.

14. The apparatus of claim 12 wherein there is a bag positioner station remote from the filling station, further characterized in that the carriage assembly mounting means includes means for mounting and moving the carriage assembly between the positioner and filling stations, that there is provided means for supporting a flat folded bag at the positioner station with the bag top edge above its bottom edge, that the carriage assembly includes a carriage frame, that the first means includes front clamp members for clampingly engaging opposite bag side walls of a flat folded bag adjacent the bag top and leading edges, rear clamp members for clampingly engaging opposite bag side walls of a flat folded bag adjacent the bag top edge and trailing edge, operative seventh means for mounting and relatively moving the front clamp members between a bag clamping and a bag unclamping position, operative eighth means for mounting and relatively moving the rear clamp members between a bag clamping and a bag unclamping position, nineth means for mounting the seventh and eighth means on the carriage frame, vacuum cup means for grippingly engaging opposite bag side walls of a bag clamped by the clamp members and moving the side walls to a bag mouth open condition, and operative tenth means for mounting the vacuum cup means on the carriage frame and moving them between a first position to grippingly engage a flat folded bag clamped by the clamp members and a second position to open and hold the bag mouth open.

15. The apparatus of claim 14 further characterized in that the nineth means includes power operative eleventh means for relatively moving the seventh and eighth means to move the front and rear clamp members between an "in" position and an "apart" position that the front and rear clamp members are longitudinally more remotely spaced from one another than they are in their "in" position, that the spout includes spout jaws and operative means on the carriage frame for moving the spout jaws between an up position and a down position to extend into the open bag mouth, and that the control means includes means to operate the tenth means to move the vacuum cup means to their first position to grippingly engage a flat folded bag clamped by the clamp members in the seventh and eighth means apart position and with the spout jaws in their up position, then operate the tenth and eleventh means to through the seventh and eighth means move the clamp members to their "in" position and the vacuum cup means to their second position and operate the spout jaw operative means to move the spout jaws toward their down position after the vacuum cup means are moved from their first position toward their second position.

16. The apparatus of claim 14 further characterized in that there is provided a bag magazine for supporting a vertical stack of flat folded bags transversely spaced from the positioner station with the bag top edges transversely more remotely spaced from the bag supporting means than the bag bottom edges, bag pick up means on the elongated frame for grippingly engaging the top bag on the stack adjacent the bag bottom edge and transversely moving the picked up bag toward the positioner station with the bag bottom edge in advance of the bag top edge, means for receiving the picked up bag from the pick up means and in cooperation with the bag supporting means at the positioner station move the bag to and retain the bag in an upright condition with the bag top edge above the bag bottom edge in a position to be clampingly engaged by the clamp members and saddle and shaker means at the filling station for shaking the bag as it is being filled and is clampingly engaged by the clamp members.

17. In apparatus for opening and filling a flat folded bag having opposite side walls, a top peripheral edge defining a bag mouth, a bottom edge, a leading edge and a trailing edge including moving the bag from a first station to a filling station remote from the first station, a longitudinally elongated main frame having a front end and a rear end, a carriage assembly, first means for mounting the carriage assembly on the main frame for movement between the first station and the filling station, operative second means for moving the carriage assembly between the stations, said carriage assembly including a carriage frame, a spout, third means for mounting the spout on the carriage frame for directing product into the opened bag, front clamp members for clampingly engaging opposite bag side walls of a flat folded bag adjacent the bag top and trailing edges, operative fourth means for mounting and relatively transversely moving the front clamp members between a bag clamping position at the first station and a bag unclamping position at the filling station, operatve fifth means for mounting and relatively transversely moving the rear clamp members between a bag clamping and a bag unclamping position, power operative sixth means for mounting the fourth and fifth means on the carriage frame and relatively moving them to longitudinally move the front clamp members relative to the rear clamp members to an "in" position and an "apart" position that the front clamp members are further longitudinally spaced from the rear clamp members than in their "in" position, first and second vacuum cup means for grippingly engaging opposite bag side walls longitudinally between the front and rear clamp members, and operative seventh means for mounting the vacuum cup means on the carriage frame and moving the first and second cup means transversely toward one another to a first position to grippingly engage the flat folded bag side walls and transversely away from one another to a second position to open the bag mouth and hold the bag mouth open, control means for operating the operative means including the seventh means for moving the vacuum cup means to their first position to grippingly engage a flat folded clamped bag while the clamp members are in their bag clamping "apart" position, then the sixth and seventh means for moving the clamp members to their "in" position and the vaccum cup means to their second position and after the bag is filled the sixth and seventh means to move the clamp members to the "apart" position and to release the clamping engagement by the vacuum cup means and close the bag mouth and the fourth and fifth means to move the clamp members to their bag clamping position at the first station, and eighth means for supporting a flat folded bag in a position for being clampingly engaged by the clamp members when the clamp members are moved to their bag clamping position.

18. The apparatus of claim 17 further characterized in that the spout includes spout jaws and operable nineth means for mounting the spout jaws on the carriage frame and moving them between an up position at a higher elevation than the bag top edge of a bag clamped by the clamp members and a down position extending into the open bag mouth, and that the control means includes means for operating the nineth means to move the spout jaws toward their down position after the seventh means moves the vacuum cup means from their first position toward their second position.

19. The apparatus of claim 17 wherein there is a discharge station remote from the filling station, further characterized in that there is provided a first and a second transfer subassembly, means for mounting the subassemblies in transverse spaced relationship for movement between the filling and discharge stations, operative nineth means for moving the subassemblies between the filling and discharge stations, such subassembly including a longitudinally elongated gripper of a length at least substantially as great as the spacing of the bag leading and trailing edges, a transfer carriage movably mounted on the subassembly mounting means, and operable tenth means for mounting the gripper and moving the gripper between a first position to cooperate with the gripper of the other subassembly to grippingly engage the bag side walls above the level of product in the filled bag and a second position transversely remotely spaced from the gripper of said other subassembly, and that the control means includes means for operating the tenth means to move the grippers to their first position when the transfer subassemblies are at the filling station and before the clamp members are moved to their unclamping position to release the filled bag and to their second position after the subassemblies are at the discharge station and the nineth means to move the subassemblies from the filling station to the discharge station after the grippers have been moved to their first position to grippingly engage a filled bag.

20. The apparatus of claim 19 further characterized in that each subassembly includes a second gripper mounted by and movable by the respective tenth means for in the first gripper first position grippingly engaging the adjacent bag side wall vertically between the level of product in the filled bag and the bag bottom of the filled bag.

21. The apparatus of claim 17 further characterized in that the eighth means is rearwardly of the filling station and includes a vertical first bag support member, a bag bottom support and a second bag support member to cooperate with the bag bottom support and the first support member to retain a bag in a generally vertical position with the leading edge forwardly of the trailing edge and the top edge above the first and second support members in a position to be clamingly engaged by the clamp members.

22. The apparatus of claim 21 wherein there is provided a magazine for supporting flat folded bags transversely adjacent the support members, and operative means on the main frame for removing a flat folded bag from the magazine and feeding it toward the second support member to move between the support members and abut against the bag bottom support, further characterized in that the second support member includes a lower part having an upper edge portion above the elevation of the bag bottom support, and an upper part hingedly connected to the lower part for movement between a vertical position and a position inclined upwardly toward the magazine and that the eighth means includes operative means for moving the upper part to its inclined position prior to a bag being fed toward the second support member and after the fed bag is adjacent the bag bottom support move the upper part to its vertical position.

23. In apparatus for feeding a flat folded bag having opposite side walls, a top peripheral edge defining a bag mouth, a bottom edge, a leading edge and a trailing edge from a magazine and moving the bag to a filling station, a longitudinally elongated frame having a front end and a rear end and a positioner station more closely adjacent the rear end than the front end with the filling station being between the positioner station and the front end, a first bag side wall vertical support member having an upper edge and a longitudinal vertical support planer surface portion, a bag bottom support joined to the first support member and being at a sufficiently lower elevation than the first support member upper edge that a flat folded bag supported in a vertical position with the bag bottom edge abutting against the bag bottom support, the bag top edge extends above the first support member top edge, operative first means for moving a flat folded bag from the magazine and feeding it to have the bag bottom edge supported on the bottom support, and in cooperation with the first support member and bottom support supporting the flat folded bag in a vertical position to be clampingly engaged adjacent the bag top edge, said first means including a second bag side wall support member for cooperating with the first support member and bottom support to retain the flat folded bag in a vertical position, the second support member having a longitudinal vertical planar surface portion parallel to the first support member planar surface portion and transversely spaced therefrom a distance a little greater than the maximum thickness of the flat folded bag, said planar surface portions extending above the bottom support with the bottom support therebetween, said support members being mounted on the main frame at the positioner station, a carriage assembly, operative second means for mounting the carriage assembly and moving the carriage assembly between a position above the support members and a bag filling position at the filling station, said carriage assembly having operative third means for clampingly engaging the flat folded bag that is between the support members and retaining the bag in clamping engagement as the carriage assembly moves from the positioner station to the filling station and control means for operating the operative means.

24. The apparatus of claim 23 wherein the magazine supports a vertical stack of the flat folded bags transversely spaced from the second support member and transversely more remote from the first support member than the second support member with the bag bottom edge more closely adjacent the second support member than the bag top edge, further characterized in that the first means includes fourth means for receiving a picked up bag at a higher elevation than the first support member top edge and feeding the picked up bag to move downwardly to have the bag bottom edge abut against the bottom support between said planar surface portions, and operative fifth means for engaging the top bag on the stack of bags more closely adjacent the bag bottom edge than the bag top edge, picking up the bag and moving the picked up bag to the fourth means to be received thereby.

25. In a method of filling and closing a bag, the steps of mechanically clampingly engaging opposite side walls of a flat folded bag adjacent the bag top and leading edges and supportingly carrying the clamped bag from a bag clamping position to a filling station, vacuumly grippingly engaging the opposite side walls of the clamped bag and pulling the bag top side wall portions apart to open the bag mouth, inserting filling spout members into the opened bag while the side walls are mechanically clampingly and vacuumly grippingly engaged, discharging product through the spout members inserted into the bag to fill the bag while clampingly and vacuumly engaged, withdrawing the spout members from the bag mouth after the bag is filled, releasing the vacuum gripping engagement of the side walls after the bag is filled and while the bag is mechanically clampingly engaged, then closing the bag mouth of the clampingly engaged, filled bag, mechanically grippingly engaging opposite bag side walls of the filled bag at a first location that is between the level of product in the bag and and the bag top edges after the bag mouth is closed and while the bag is mechanically clampingly engaged for partially supportingly suspending the filled bag, and mechanically grippingly engaging opposite bag side walls of the filled bag at a second location vertically spaced from the first location that is between the level of product in the bag and the bag bottom after the bag mouth is closed and while the filled bag is mechanically clampingly engaged for partially supportingly suspending the filled bag, releasing the mechanical clamping engagement of the filled bag after it is mechanically grippingly engaged and thence moving the thus mechanically grippingly engaged filled bag from the filling station to the discharge station.

* * * * *

UNITED STATES PATENT AND TRADEMARK OFFICE

CERTIFICATE OF CORRECTION

PATENT NO. : 4,561,238

DATED : December 31, 1985

INVENTOR(S) : Robert E. Odom

It is certified that error appears in the above-identified patent and that said Letters Patent are hereby corrected as shown below:

Column 3, line 59, after "connected", insert --at--;
Column 12, line 8, change "os" to --of--;
Column 23, line 68, change "to" to --top--; and
Column 29, line 10, change "such" to --each--.

Signed and Sealed this

First Day of April 1986

[SEAL]

*Attest:*

DONALD J. QUIGG

*Attesting Officer*

*Commissioner of Patents and Trademarks*